US006968780B2

(12) United States Patent
Birch

(10) Patent No.: US 6,968,780 B2
(45) Date of Patent: Nov. 29, 2005

(54) HAND ACCENT STENCIL APPLICATOR SYSTEM

(75) Inventor: Shane D. Birch, Laramie, WY (US)

(73) Assignee: University of Wyoming, Laramie, WY (US)

( * ) Notice: Subject to any disclaimer, the term of this patent is extended or adjusted under 35 U.S.C. 154(b) by 0 days.

(21) Appl. No.: 10/844,843

(22) Filed: May 13, 2004

(65) Prior Publication Data

US 2005/0005788 A1 Jan. 13, 2005

Related U.S. Application Data

(60) Provisional application No. 60/470,938, filed on May 15, 2003.

(51) Int. Cl.[7] ..... B41F 15/00

(52) U.S. Cl. ..... 101/114; 101/123; 101/124; 101/125; 101/126; 101/127; 101/128; 101/128.1

(58) Field of Search ..... 101/114, 123, 124–127, 101/127.1, 128, 128.1

(56) References Cited

U.S. PATENT DOCUMENTS 3,799,053 A * 3/1974 Rabelow ..... 101/125
3,886,863 A * 6/1975 Carabott et al. ..... 101/125
4,048,918 A * 9/1977 Peck ..... 101/114
4,141,292 A * 2/1979 Hirata ..... 101/125
4,164,183 A * 8/1979 Peck ..... 101/114
4,204,468 A * 5/1980 Harrison ..... 101/31.1
4,574,693 A * 3/1986 Fink et al. ..... 101/3.1
5,205,214 A * 4/1993 Seo et al. ..... 101/333
5,483,880 A * 1/1996 Seo et al. ..... 101/125
5,596,925 A * 1/1997 Hasegawa ..... 101/127.1
5,694,844 A * 12/1997 Taira ..... 101/125
5,743,182 A * 4/1998 Kobayashi et al. ..... 101/129
5,953,989 A * 9/1999 Uchiyama et al. ..... 101/129
6,105,821 A * 8/2000 Christine et al. ..... 222/105
6,158,338 A * 12/2000 MacRaild et al. ..... 101/123

* cited by examiner

*Primary Examiner*—Daniel J. Colilia
*Assistant Examiner*—Andrea H. Evans
(74) *Attorney, Agent, or Firm*—Emery L. Tracy

(57) ABSTRACT

A hand accent stencil applicator system for positioning a design on a surface is provided. The applicator system comprises an applicator handle and a compression housing mounted to the applicator housing. A bladder is positioned within the compression housing for holding a texture material. A design template is mounted to the compression housing wherein the applicator handle exerts forces into the compression housing causing a texture flow from the bladder through the design template.

29 Claims, 31 Drawing Sheets

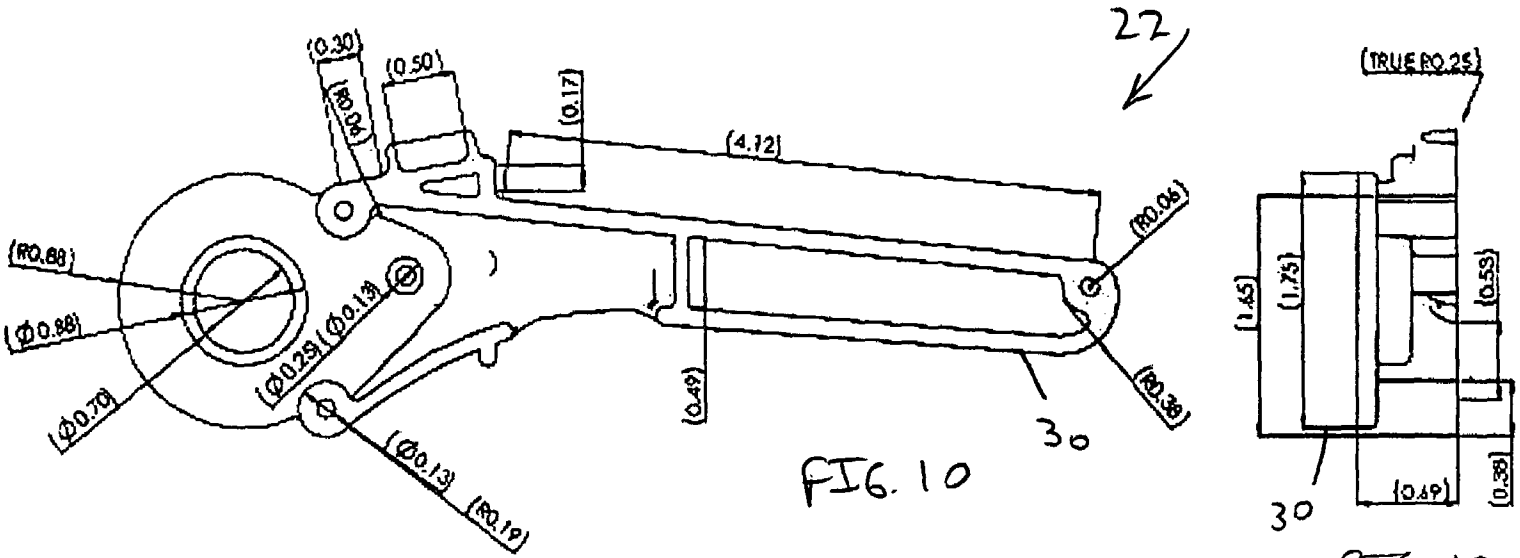
FIG. 10
FIG. 12
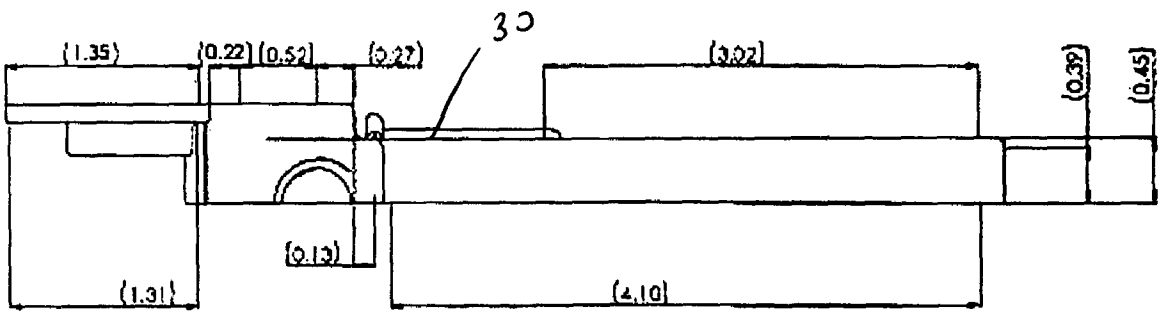
FIG. 11

Colored Mountains Design Pattern

An exploded view of
The Compression
Housing

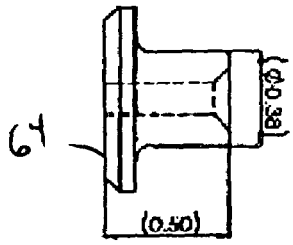
FIG. 68
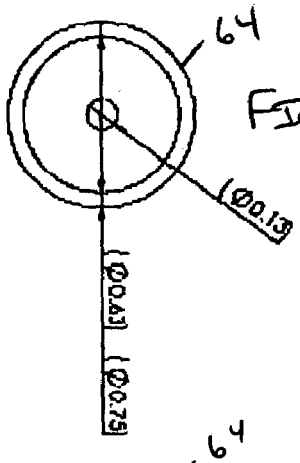
FIG. 69
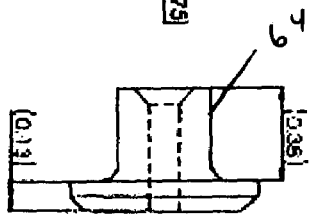
FIG. 67
FIG. 71
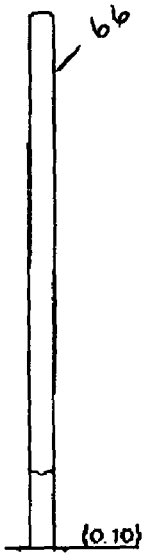
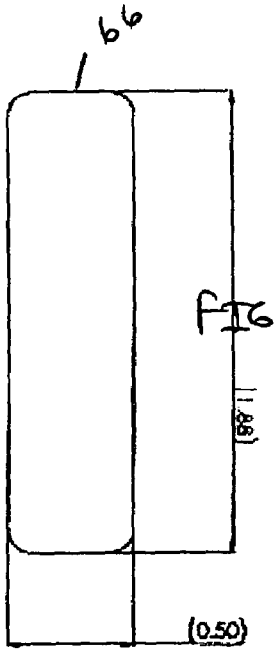
FIG. 72
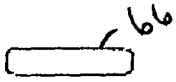
FIG. 70

The Adjustable Head Internally Feed Paint Brush

The Brush is designed to internally feed paint to the ends of the nylon brissles.

An exploded view of The Paint Brush noting a mirror image to complete the brush end

HAND ACCENT STENCIL APPLICATOR SYSTEM

The present application is a continuation of provisional patent application Ser. No. 60/470,938, filed on May 15, 2003, now abandoned, entitled "Hand Accent Stencil Applicator System".

BACKGROUND OF THE INVENTION

1. Field of the Invention

This invention relates generally to a stencil for applying designs to a surface and, more particularly, the invention relates to a hand accent stencil applicator system which easily and efficiently applies designs to a surface.

2. Description of the Prior Art

In the past, applying stencils and designs to a surface has been a tedious and time consuming task. A person would first have to affix the stencil template to the surface. He or she would then apply the paint or other medium. Then, the stencil would be removed and affixed to a different location to repeat the process. If a different design were to be applied to the same surface as the first, then he or she would have to wait until the first stencil paint dries until the process can be repeated.

Accordingly, there exists a need for a hand accent stencil applicator system which allows a person to easily and efficiently apply a design to a surface. Additionally, a need exists for a hand accent stencil applicator system which aides a person with free artistic expression with maximum ease. Furthermore, there exists a need for a hand accent stencil applicator system which frees a user to create variations on a design theme with minimal work.

SUMMARY

The present invention is a hand accent stencil applicator system for positioning a design on a surface. The applicator system comprises an applicator handle and compression housing mounted to the applicator housing. A bladder is positioned within the compression housing for holding a texture material. A design template is mounted to the compression housing wherein the applicator handle exerts forces into the compression housing causing a texture flow from the bladder through the design template.

BRIEF DESCRIPTION OF THE DRAWINGS

FIG. 10 is an elevational side view illustrating a first ratchet handle portion of a ratchet handle of the applicator handle, constructed in accordance with the present invention;

FIG. 11 is a top plan view illustrating the first ratchet handle portion of the ratchet handle, constructed in accordance with the present invention;

FIG. 12 is an end view illustrating the first ratchet handle portion of the ratchet handle, constructed in accordance with the present invention;

FIG. 67 is a front view illustrating an axis cap, constructed in accordance with the present invention;

FIG. 68 is an elevational side view illustrating the axis cap, constructed in accordance with the present invention;

FIG. 69 is a top plan view illustrating the axis cap, constructed in accordance with the present invention;

FIG. 70 is a front view illustrating a level backing, constructed in accordance with the present invention;

FIG. 71 is an elevational side view illustrating the level backing, constructed in accordance with the present invention;

FIG. 72 is top plan view illustrating the level backing, constructed in accordance with the present invention;

DETAILED DESCRIPTION OF THE PREFERRED EMBODIMENTS

Figure 1:
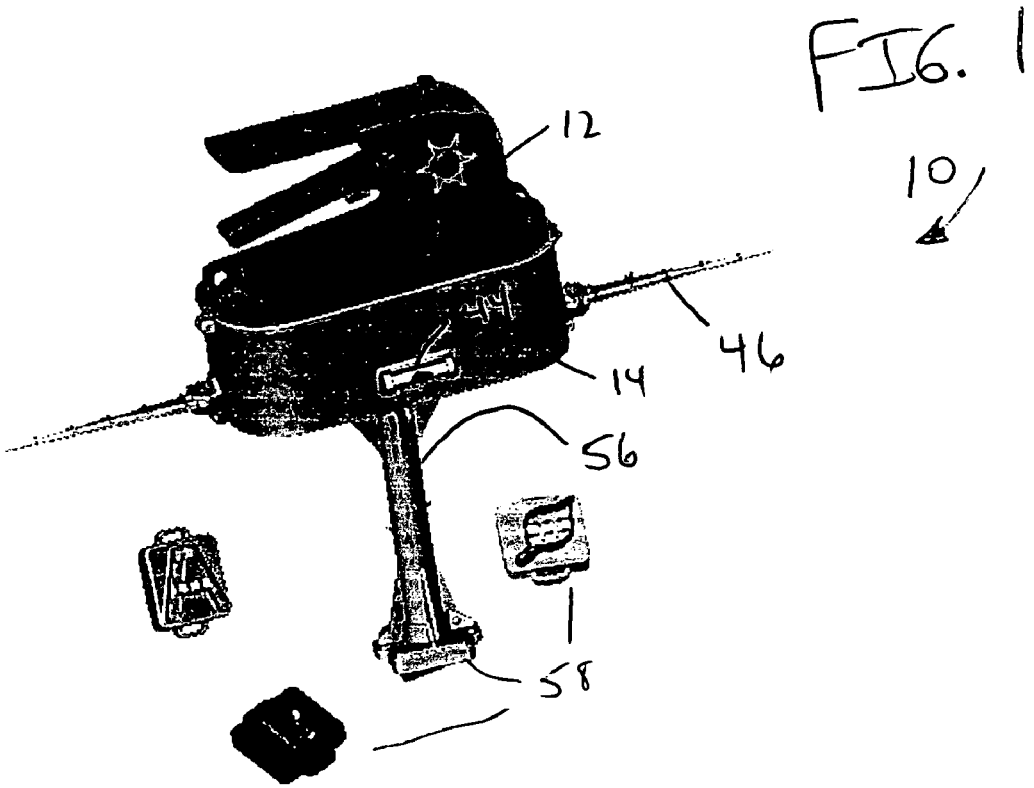
FIG. 1 is a perspective view illustrating a hand accent stencil applicator, constructed in accordance with the present invention.

As illustrated in FIG. 1, the present invention is a hand accent stencil applicator system, indicated generally at 10, for applying a design to a surface. The hand accent stencil applicator system 10 of the present invention is a decorating tool utilizing tensile forces exerted on a pool of mono- or multi-colored texture. The pressure created causes the encompassed texture is then expelled through one of the design templates, as will be described in further detail below.

In short, the hand accent stencil applicator system 10 comprises an applicator handle 12, a compression housing 14, and design template 16. The compression housing 14 surrounds the texture pool reinforcing the perimeter wall. The compression housing 14 provides mounting areas for a level bubble and guide pins (both described in further detail below) which aid in the alignment of the image on the wall surface. The design template 16 is preferably an artistic creation that provides a path for the colored texture to travel through giving form to the extruded mass. The majority of components are preferably molded from an ABS plastic, the gearing is preferably molded from acetyl plastic, and the stencils preferably have injected rubber seals. It should be noted, however, that the present invention is not limited to the materials listed and other materials are within the scope of the present invention.

Figure 2:
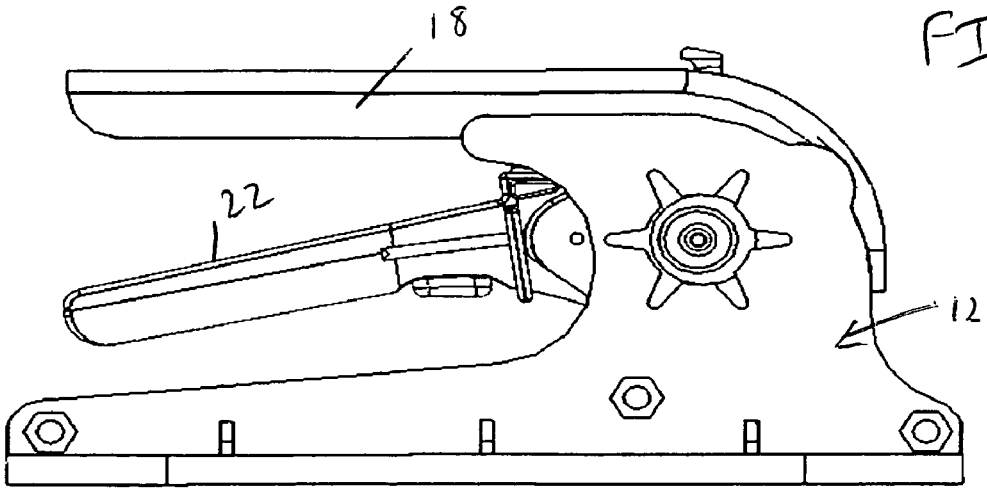
FIG. 2 is a side elevational view illustrating an applicator handle of the hand accent stencil applicator, constructed in accordance with the present invention.
Figure 3:
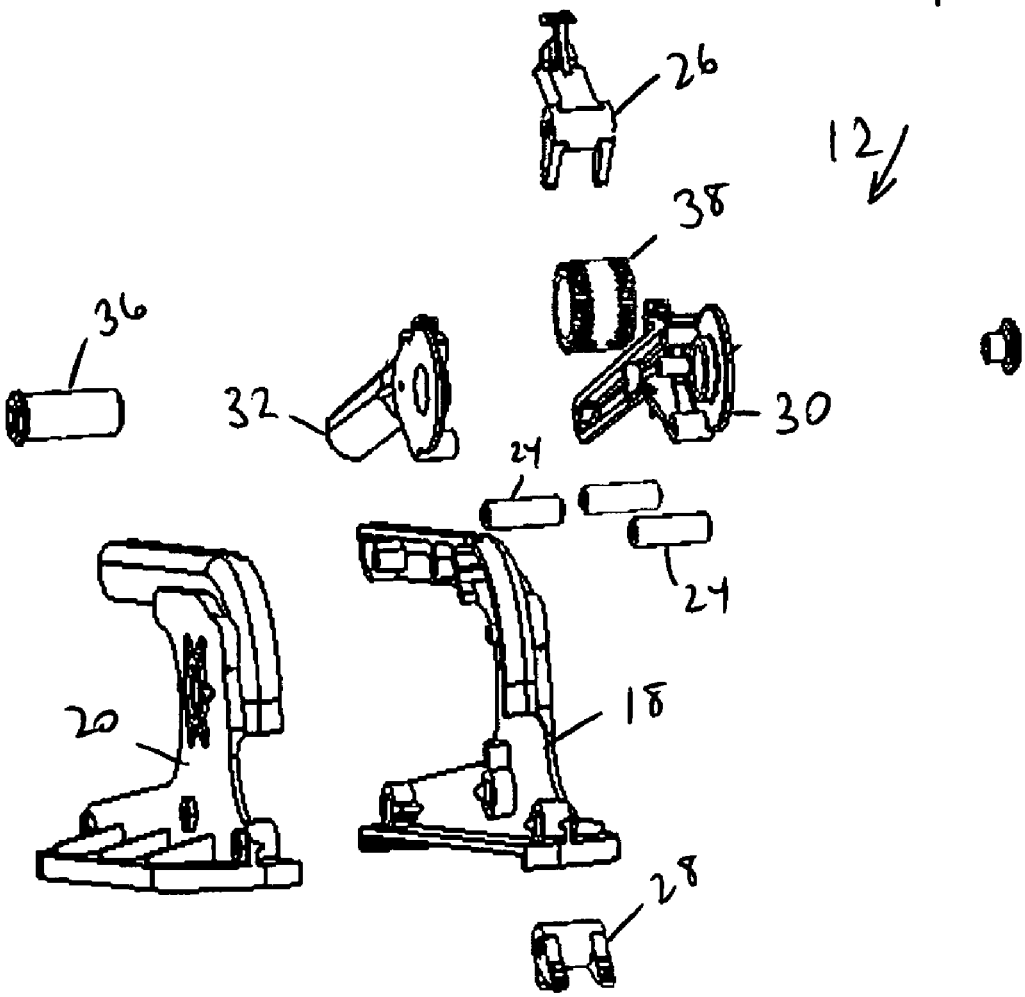
FIG. 3 is an exploded view illustrating the applicator handle of the hand accent stencil applicator, constructed in accordance with the present invention.
Figure 5:
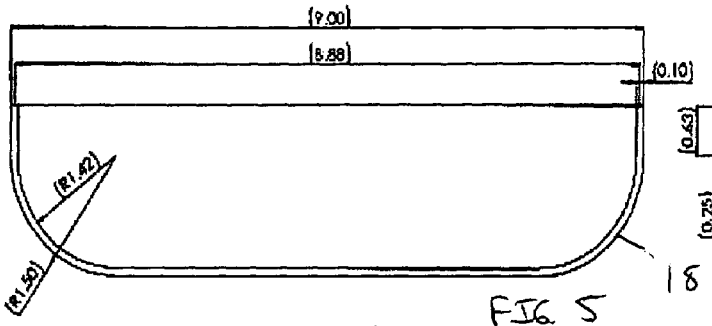
FIG. 5 is a top plan view illustrating the first applicator handle of the applicator handle, constructed in accordance with the present invention.
Figure 6:
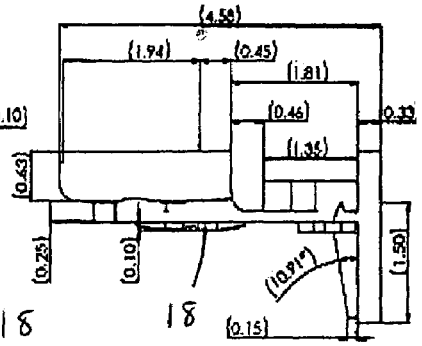
FIG. 6 is an end view illustrating the first applicator handle of the applicator handle, constructed in accordance with the present invention.
Figure 4:
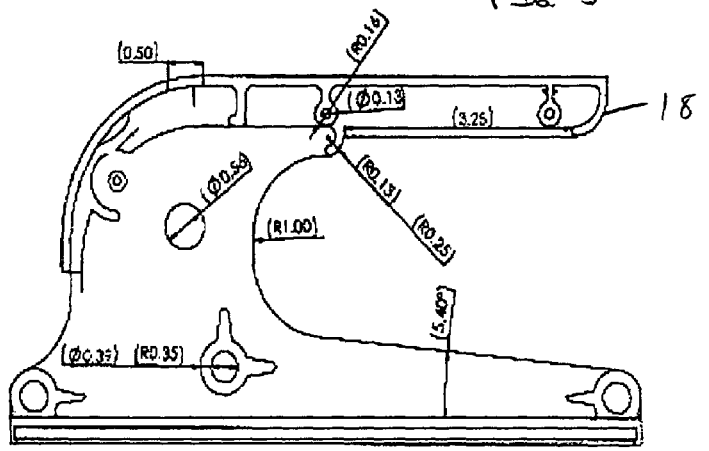
FIG. 4 is an elevational side view illustrating a first applicator handle of the applicator handle, constructed in accordance with the present invention.
Figure 9:
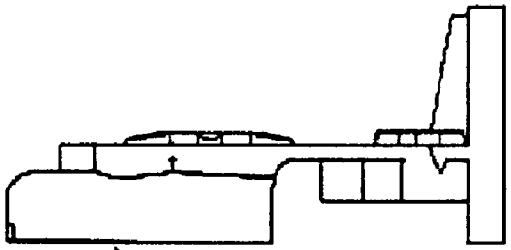
FIG. 9 is an end view illustrating the second applicator handle of the applicator handle, constructed in accordance with the present invention.
Figure 8:
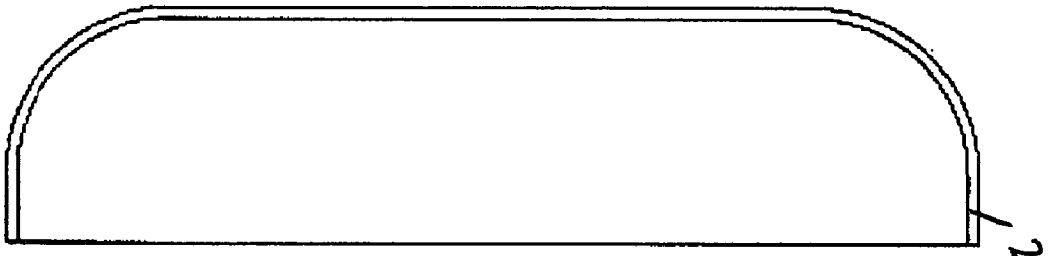
FIG. 8 is a top plan view illustrating the second applicator handle of the applicator handle, constructed in accordance with the present invention.
Figure 7:
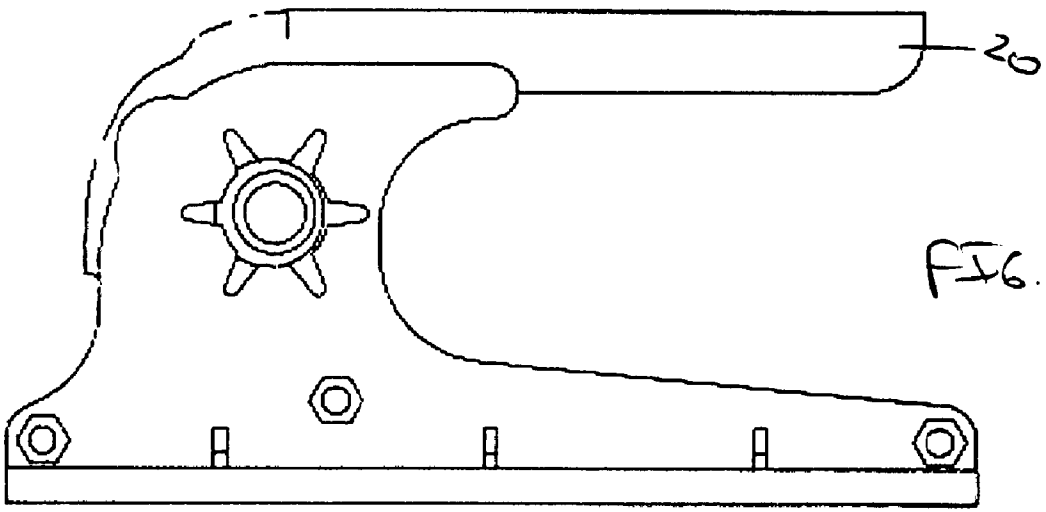
FIG. 7 is an elevational side view illustrating a second applicator handle of the applicator handle, constructed in accordance with the present invention.
Figure 15:
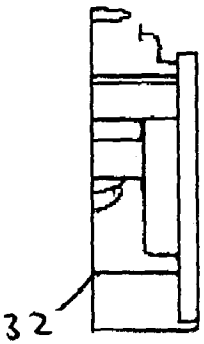
FIG. 15 is an end view illustrating the second ratchet handle portion of the ratchet handle, constructed in accordance with the present invention.
Figure 13:
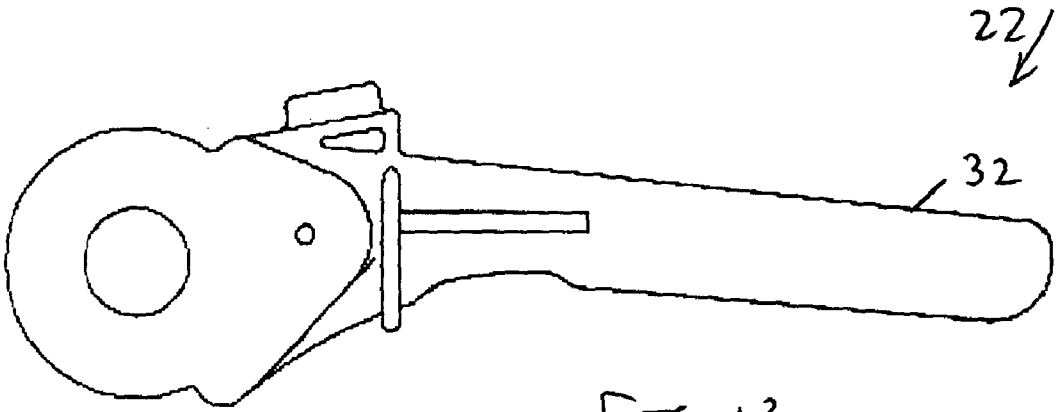
FIG. 13 is an elevational side view illustrating a second ratchet handle portion of the ratchet handle of the applicator handle, constructed in accordance with the present invention.
Figure 14:
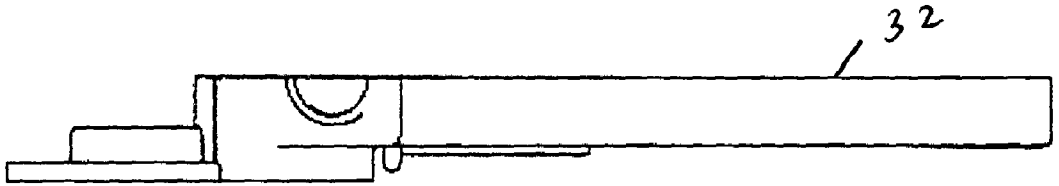
FIG. 14 is a top plan view illustrating the second ratchet handle portion of the ratchet handle, constructed in accordance with the present invention.

As illustrated in FIGS. 2 and 3, the applicator handle 12 of the applicator system 10 of the present invention is basically a mounting base for the design template 16 or stencil and exerts forces causing a texture flow through one of the design patterns of the design template 16. The applicator handle 12 includes a first applicator handle 18 and a second applicator handle 20 (as illustrated in FIGS. 4–9) which hold a ratchet handle 22, rollers 24, a ratchet lock 26, and a directional lock 28 for providing a compressive surface to evenly exert pressure over the pool of texture within the compression housing 14.

Figure 18:
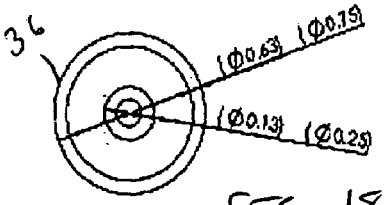
FIG. 18 is a top plan view illustrating the axis cylinder of the applicator handle, constructed in accordance with the present invention.
Figure 16:
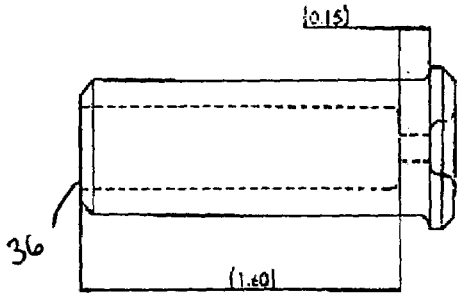
FIG. 16 is an elevational side view illustrating an axis cylinder of the applicator handle, constructed in accordance with the present invention.
Figure 17:
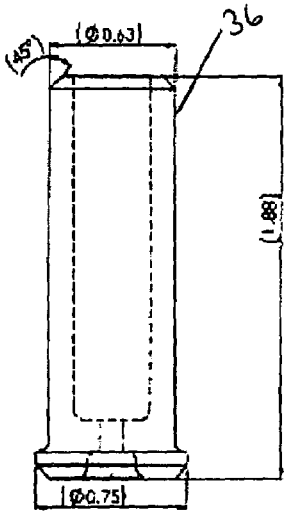
FIG. 17 is front view illustrating the axis cylinder of the applicator handle, constructed in accordance with the present invention.

As illustrated in FIGS. 10–15, the ratchet handle 22 includes a first ratchet handle 30 and a second ratchet handle 32. The first ratchet handle 30 provides leverage to the user to compress the texture and the second ratchet handle 32 encloses a compression strap 34 (as described further below) centering the axis within its grip. As illustrated in FIGS. 16–18, an axis cylinder 36 is provided for rotation of the first and second ratchet handles 30, 32 within the applicator handle 12.

Figure 21:
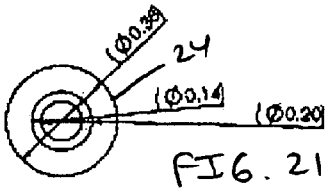
FIG. 21 is a top plan view illustrating the roller of the applicator handle, constructed in accordance with the present invention.
Figure 19:
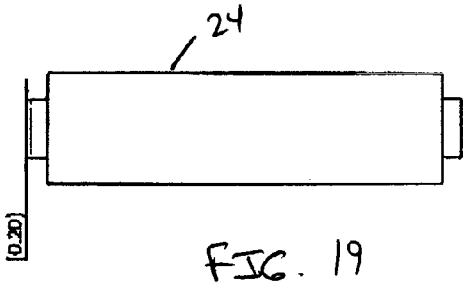
FIG. 19 is an elevational side view illustrating a roller of the applicator handle, constructed in accordance with the present invention.
Figure 20:
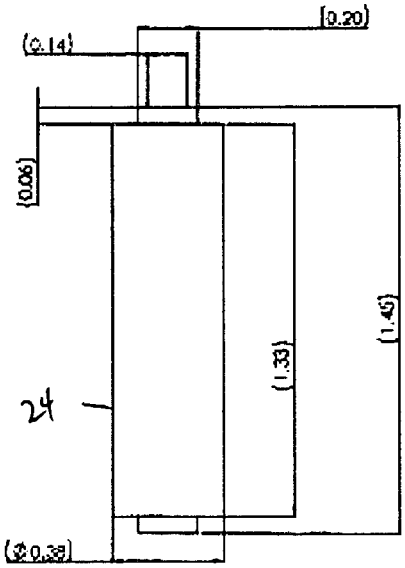
FIG. 20 is front view illustrating the roller of the applicator handle, constructed in accordance with the present invention.

As illustrated in FIGS. 19–21, the rollers 24 of the applicator handle 12 provide a path for the compression straps 34 to exert forces on the texture, excreting it through the design templates 16.

Figure 24:
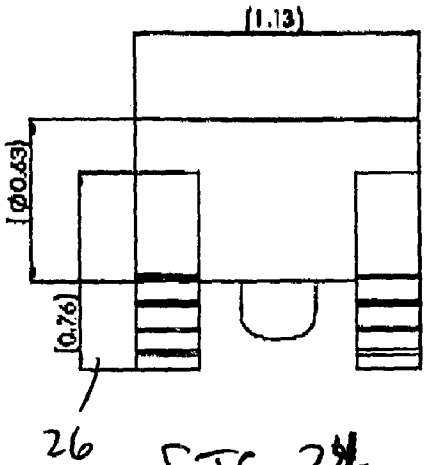
FIG. 24 is an end view illustrating the ratchet lock of the applicator handle, constructed in accordance with the present invention.
Figure 23:
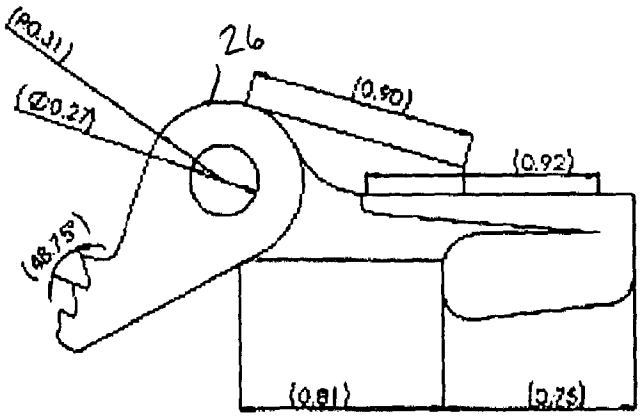
FIG. 23 is a top plan view illustrating the ratchet lock of the applicator handle, constructed in accordance with the present invention.
Figure 22:
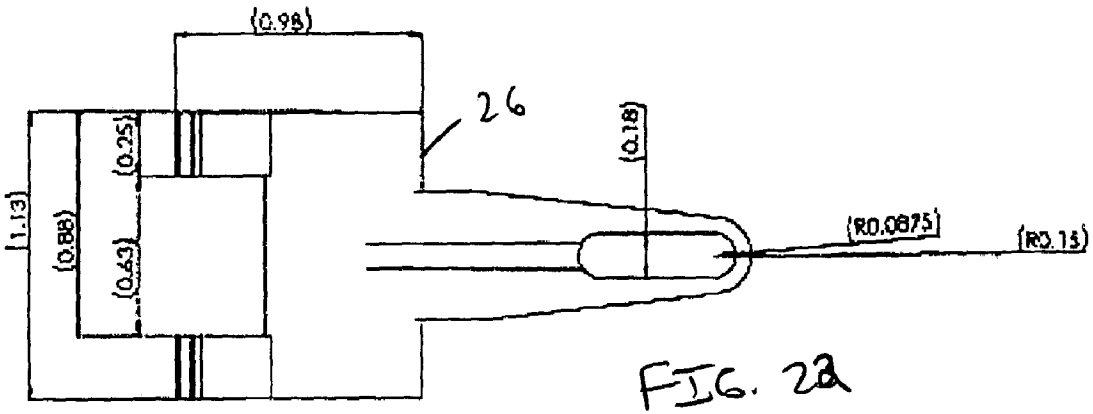
FIG. 22 is an elevational side view illustrating a ratchet lock of the applicator handle, constructed in accordance with the present invention.
Figure 26:
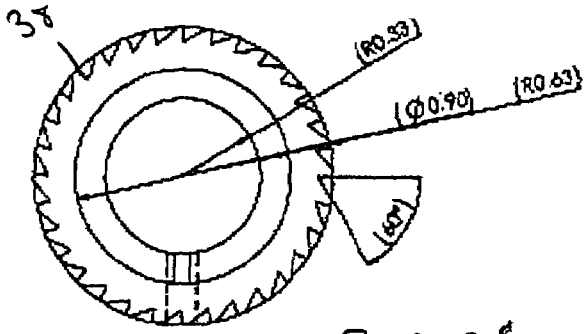
FIG. 26 is a top plan view illustrating the compression spool of the applicator handle, constructed in accordance with the present invention.
Figure 27:
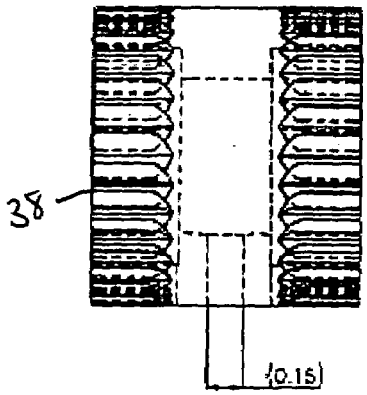
FIG. 27 is an end view illustrating the compression spool of the applicator handle, constructed in accordance with the present invention.
Figure 25:
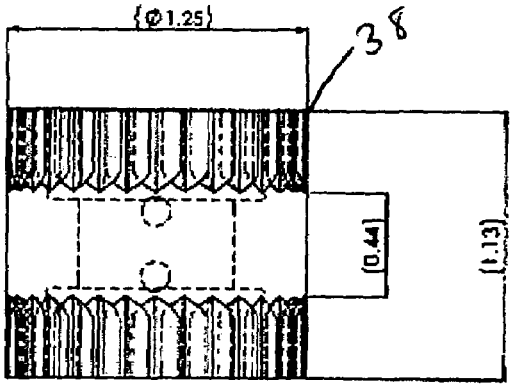
FIG. 25 is an elevational side view illustrating a compression spool of the applicator handle, constructed in accordance with the present invention.

As illustrated in FIGS. 22–24, the ratchet lock 26 of the applicator handle 12 engages a compression spool 38 (as illustrated in FIGS. 25–27) allowing for the equal angular deflection of the ratchet handle 22 and the compression spool 38. The geared compression spool 38 wraps the compression strap 34 around itself to shorten the length of the compression strap 34 thus causing the space between the applicator handle 12 and the design template 16 to shorten. This action produces the excretion of the texture from the compression housing 14 through the design template 16.

Figure 29:
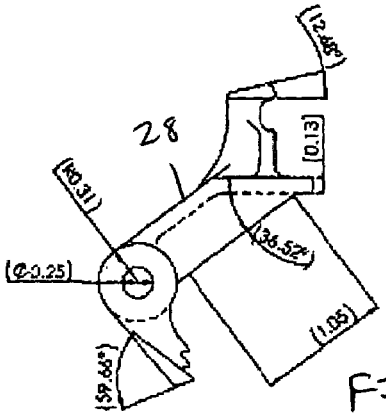
FIG. 29 is a top plan view illustrating the directional lock of the applicator handle, constructed in accordance with the present invention.
Figure 28:
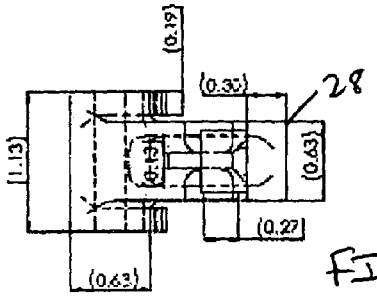
FIG. 28 is an elevational side view illustrating a directional lock of the applicator handle, constructed in accordance with the present invention.
Figure 30:
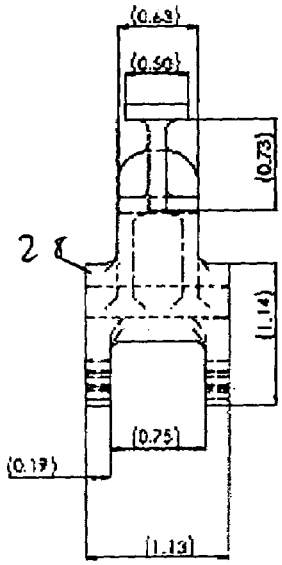
FIG. 30 is an end view illustrating a directional lock of the applicator handle, constructed in accordance with the present invention.
Figure 31:
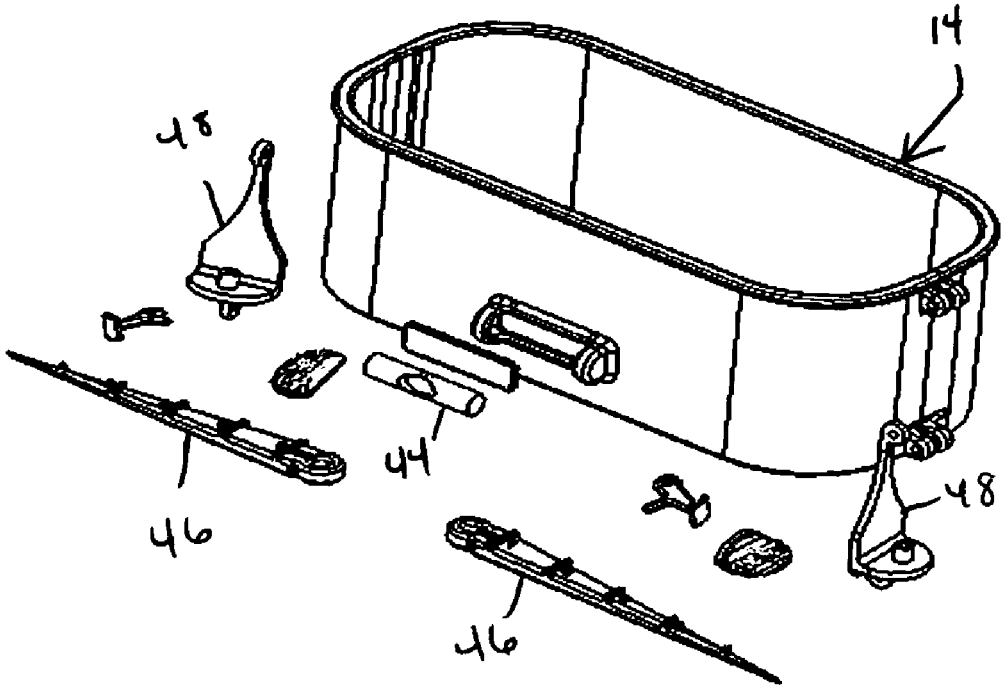
FIG. 31 is an exploded perspective view illustrating a compression housing of the applicator system, constructed in accordance with the present invention.
Figure 34:
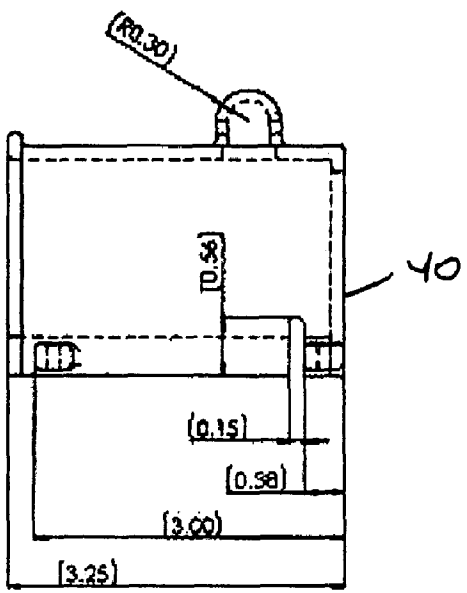
FIG. 34 is an end view illustrating the first compression housing half of the compression housing, constructed in accordance with the present invention.
Figure 33:
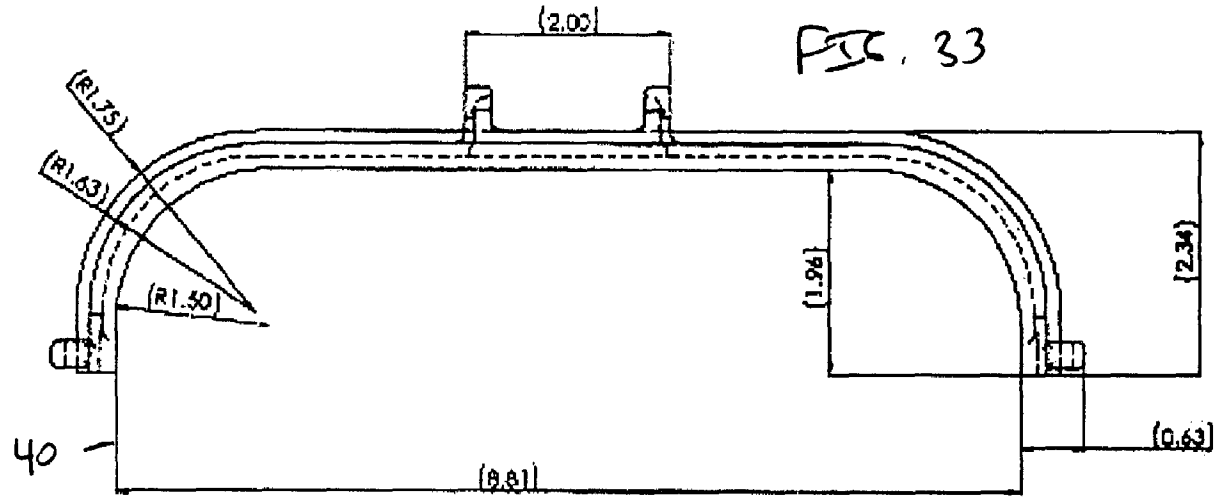
FIG. 33 is a top plan view illustrating the first compression housing half of the compression housing, constructed in accordance with the present invention.
Figure 32:
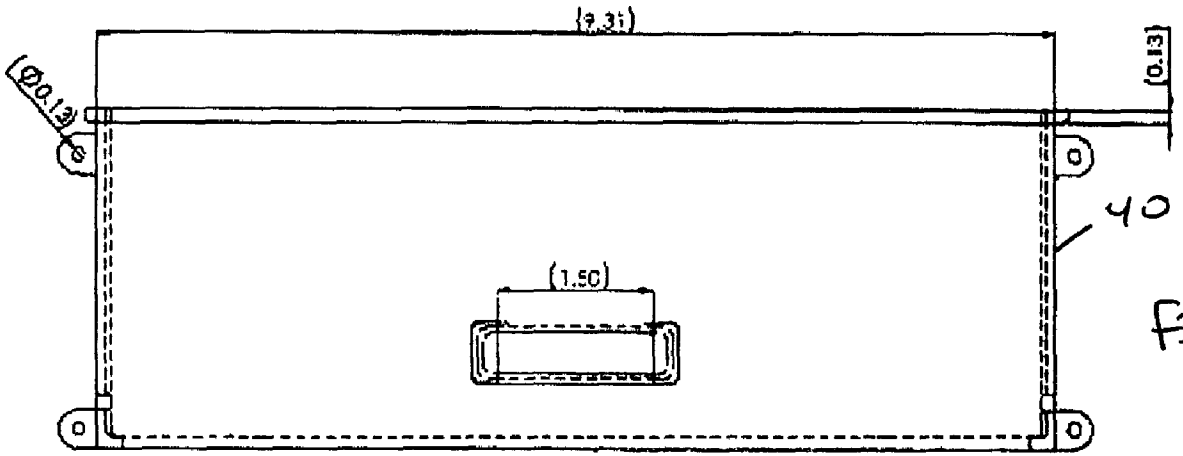
FIG. 32 is an elevational side view illustrating a first compression housing half of the compression housing, constructed in accordance with the present invention.
Figure 37:
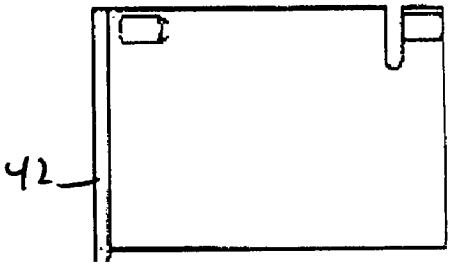
FIG. 37 is an end view illustrating the second compression housing half of the compression housing, constructed in accordance with the present invention.
Figure 36:
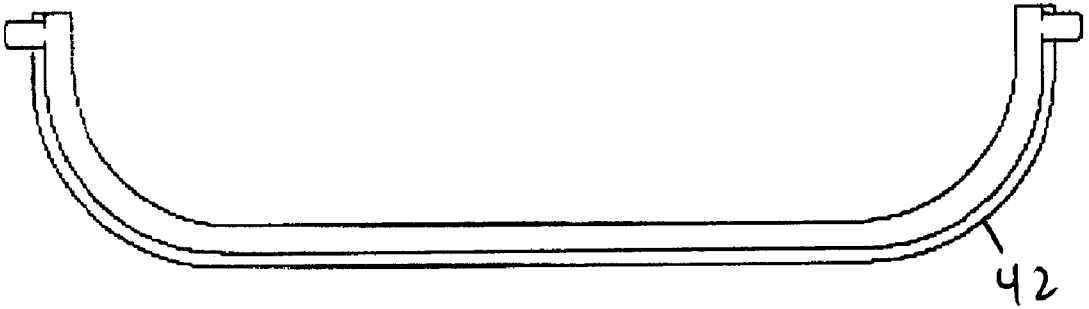
FIG. 36 is a top plan view illustrating the second compression housing half of the compression housing, constructed in accordance with the present invention.
Figure 35:
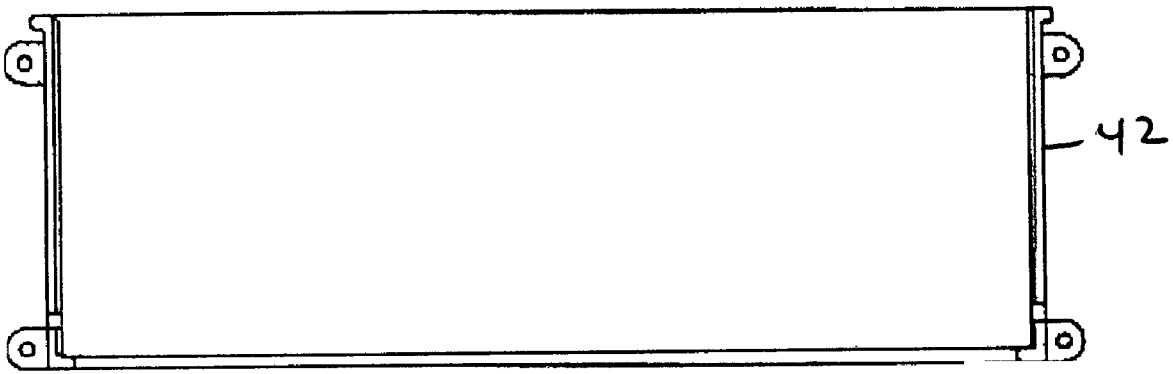
FIG. 35 is an elevational side view illustrating a second compression housing half of the compression housing, constructed in accordance with the present invention.

As illustrated in FIGS. 28–30, the directional lock 28 of the applicator handle 12 engages to inhibit the release of pressure on the texture pool providing a better stamped image through the design template 16.

As illustrated in FIGS. 31–37, the compression housing 14 of the applicator system 10 of the present invention has a first compression housing half 40 and a second compression housing half 42. The first compression housing half 40 surrounds the texture pool reinforcing the perimeter wall. The second compression housing half 42 encompasses the texture and stabilizes the mounting area for the alignment aids. Furthermore, the compression housing 12 provides mounting areas for a level bubble 44 and guide pins 46 which aid in the alignment of the image on the surface.

Figure 39:
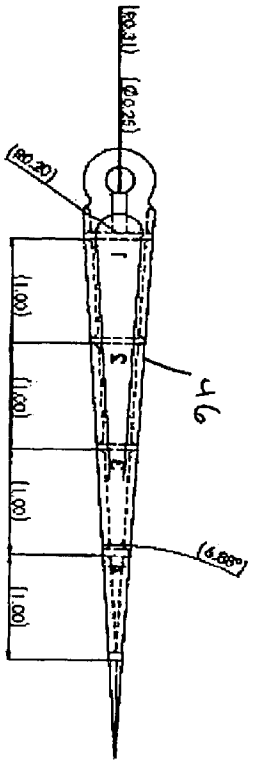
FIG. 39 is a top plan view illustrating the guide pin of the compression housing, constructed in accordance with the present invention.
Figure 40:
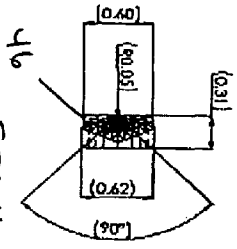
FIG. 40 is an end view illustrating the guide pin of the compression housing, constructed in accordance with the present invention.
Figure 38:
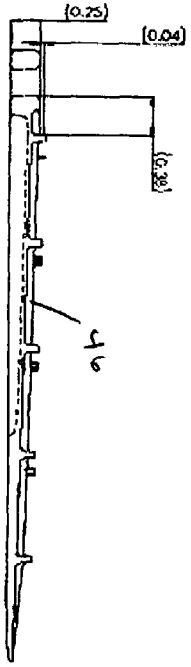
FIG. 38 is an elevational side view illustrating a guide pin of the compression housing, constructed in accordance with the present invention.
Figure 43:
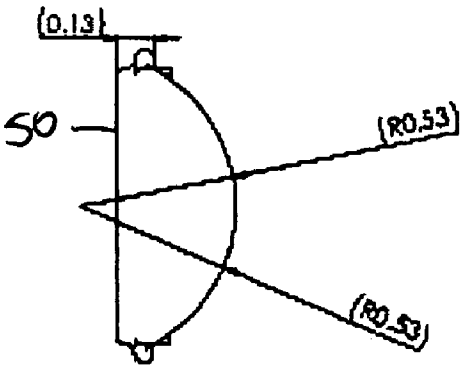
FIG. 43 is an end view illustrating the protractor indicator of the compression housing, constructed in accordance with the present invention.
Figure 42:
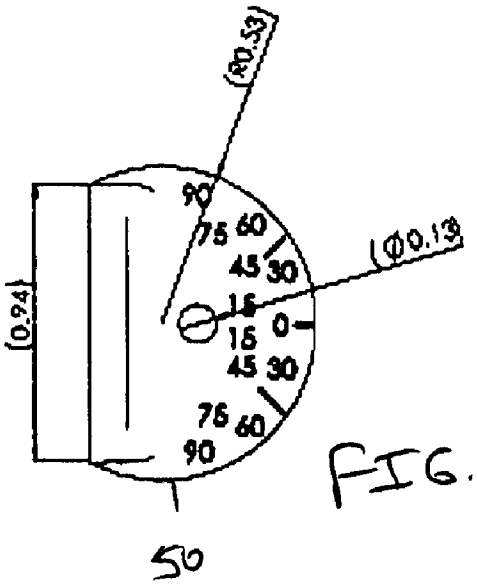
FIG. 42 is a top plan view illustrating the protractor indicator of the compression housing, constructed in accordance with the present invention.
Figure 41:
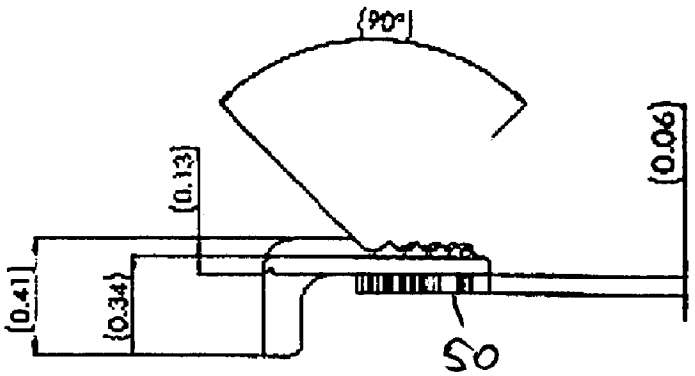
FIG. 41 is an elevational side view illustrating a protractor indicator of the compression housing, constructed in accordance with the present invention.
Figure 46:
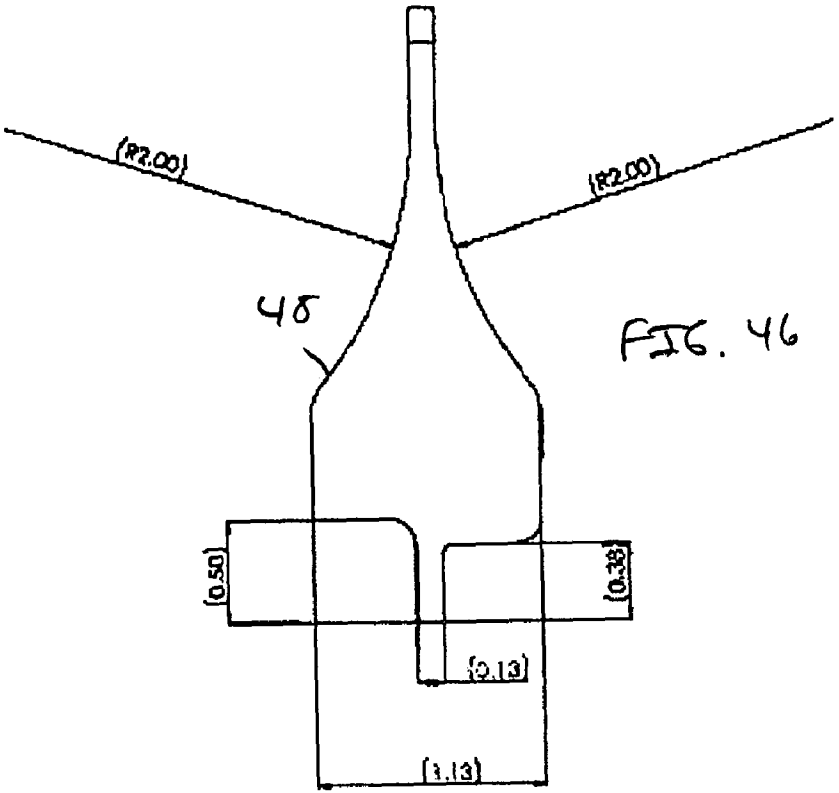
FIG. 46 is an end view illustrating the guide pin mounting bracket of the compression housing, constructed in accordance with the present invention.
Figure 45:
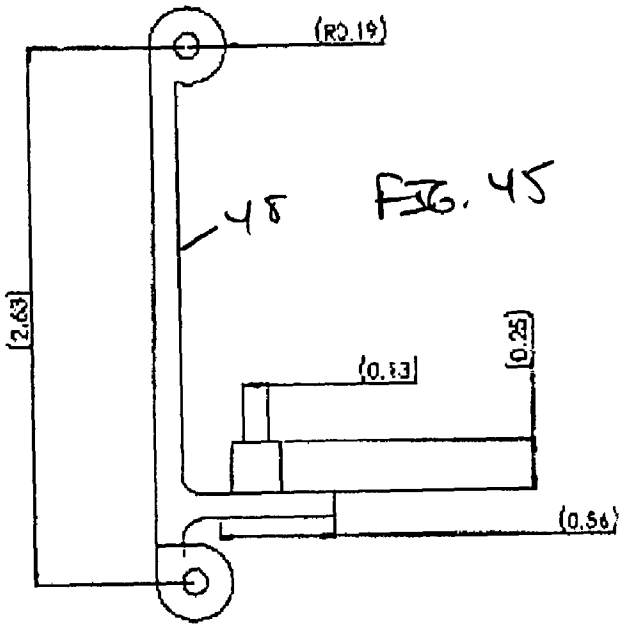
FIG. 45 is a top plan view illustrating the guide pin mounting bracket of the compression housing, constructed in accordance with the present invention.
Figure 44:
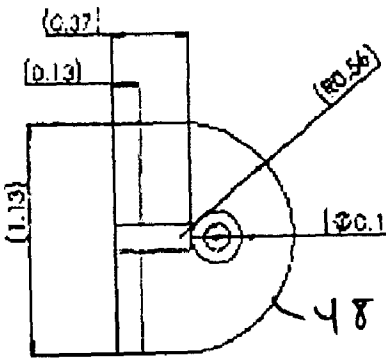
FIG. 44 is an elevational side view illustrating a guide pin mounting bracket of the compression housing, constructed in accordance with the present invention.

As illustrated in FIGS. 38–40, the guide pins 46 are mounted to the compression housing 14 with a guide pin mounting bracket 48 (as illustrated in FIGS. 44–46) mounted on the compression housing 14. The guide pin mounting bracket 48 maintains the guide pins 46 to the compression housing 14. The alignment features of the guide pins 46 provide a one inch reference along its axis and are coupled with a protractor indicator 50 (as illustrated in FIGS. 41–43) providing angular alignment to the image. The protractor indicator 50 aligns the guide pins 46 in various desired angles. The guide pins 46 and protractor indicator 50 assist the user in the placement of the desired image.

Figure 48:
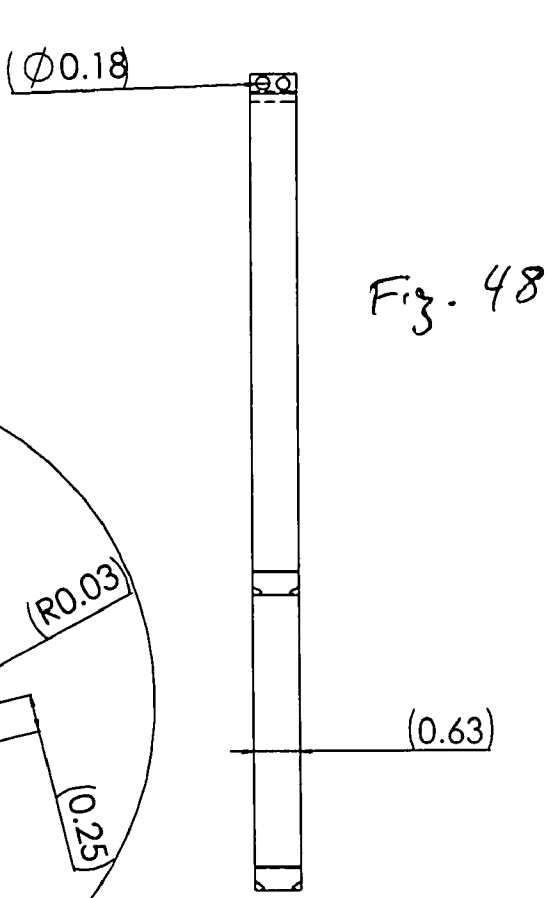
FIG. 48 is a front view illustrating the compression strap of the applicator system, constructed in accordance with the present invention.
Figure 49:
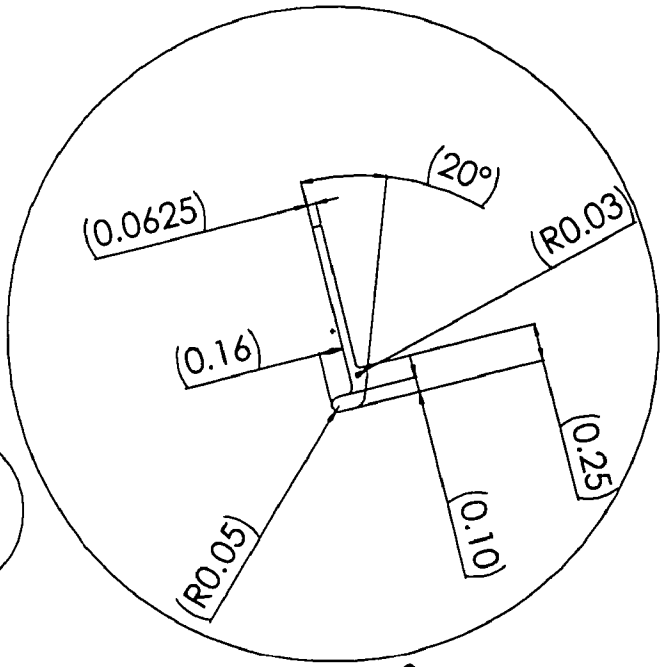
FIG. 49 is an elevational side view illustrating an end of the compression strap of the applicator system, constructed in accordance with the present invention.
Figure 47:
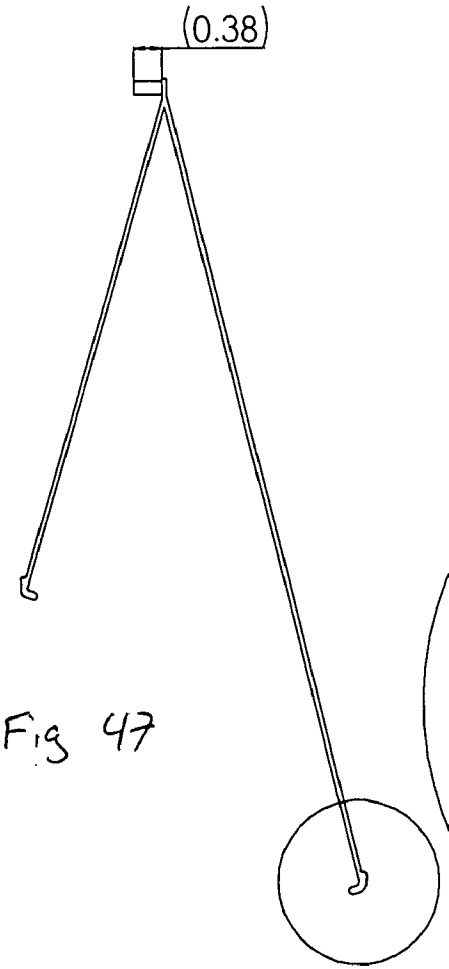
FIG. 47 is an elevational side view illustrating a compression strap of the applicator system, constructed in accordance with the present invention.
Figure 50:
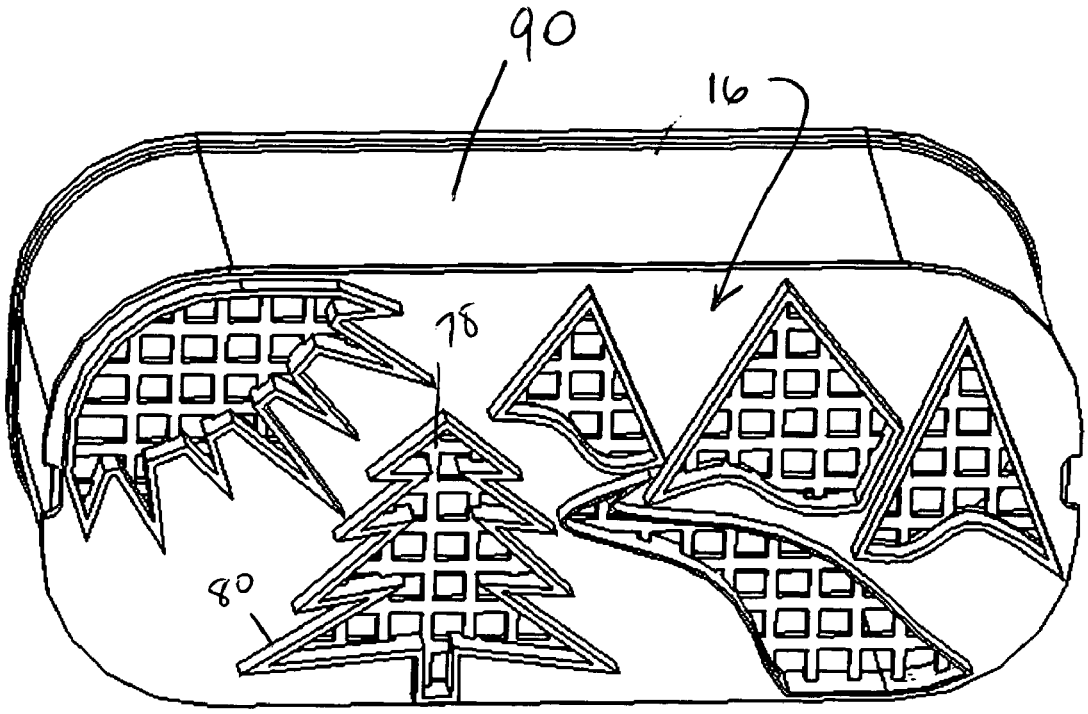
FIG. 50 is a perspective view illustrating a design template of the applicator system, constructed in accordance with the present invention.
Figure 53:
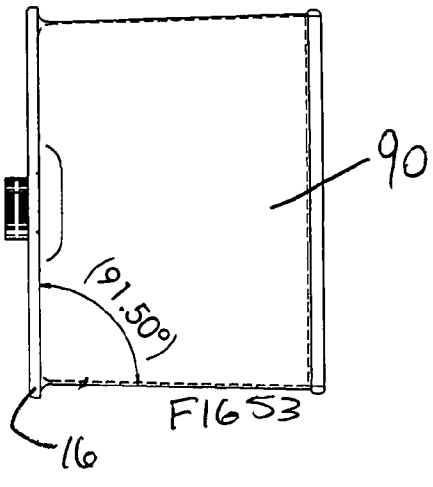
FIG. 53 is an end view illustrating the design template of the applicator system, constructed in accordance with the present invention.
Figure 52:
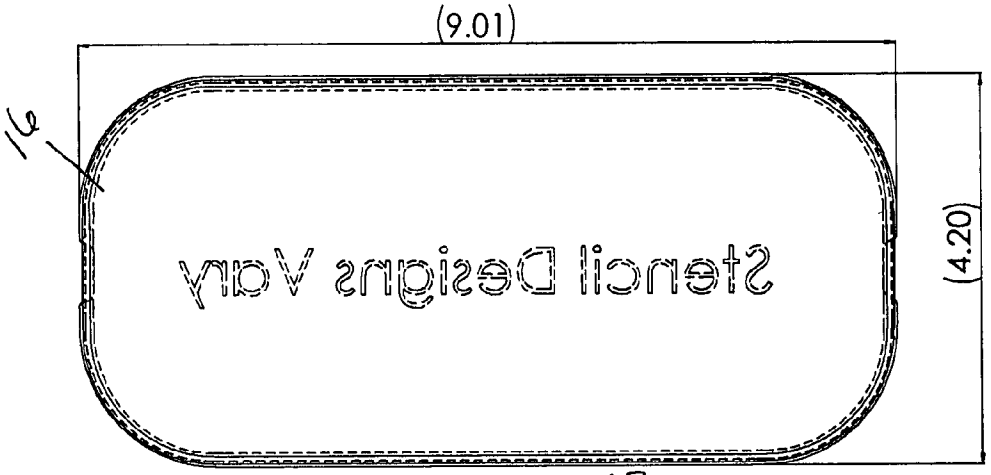
FIG. 52 is a top plan view illustrating the design template of the applicator system, constructed in accordance with the present invention.
Figure 51:
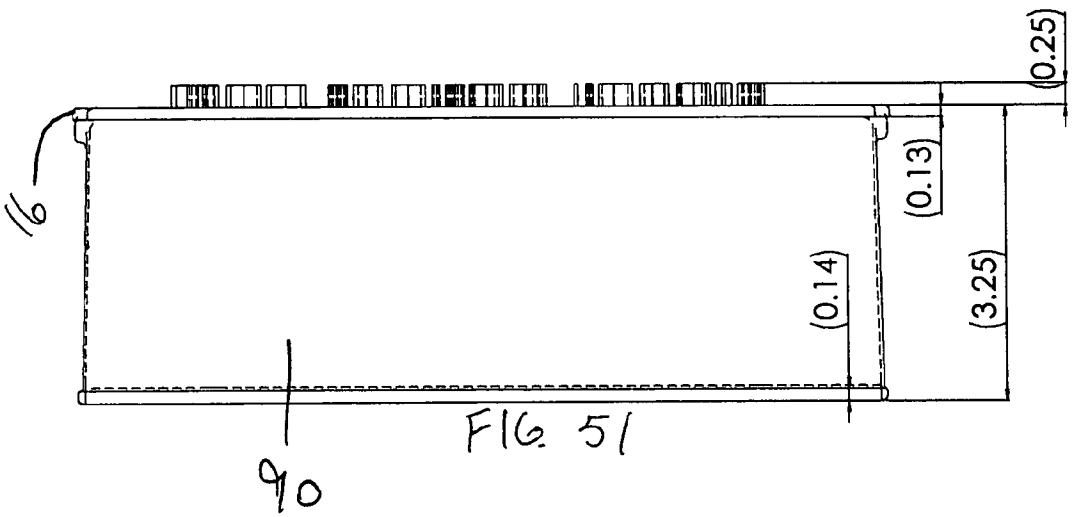
FIG. 51 is an elevational side view illustrating the design template of the applicator system, constructed in accordance with the present invention.

As illustrated in FIGS. 47–49, the applicator system further includes the compression straps 34. The compression straps 34 connect the applicator handle 12 and the design template 16 urging the applicator handle 12 and the design template 16 closer together. The compression straps 34 provide the tensile forces in the applicator system 10.

Figure 55:
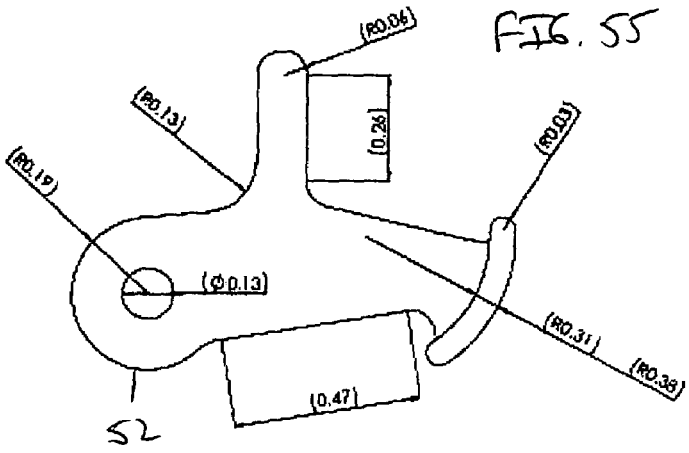
FIG. 55 is a top plan view illustrating the housing latch of the design template, constructed in accordance with the present invention.
Figure 56:
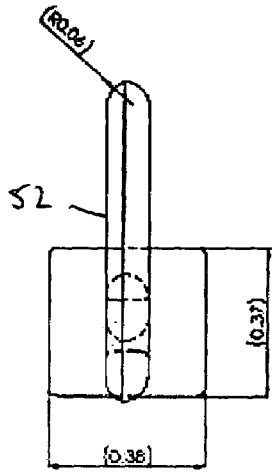
FIG. 56 is an end view illustrating the housing latch of the design template, constructed in accordance with the present invention.
Figure 54:
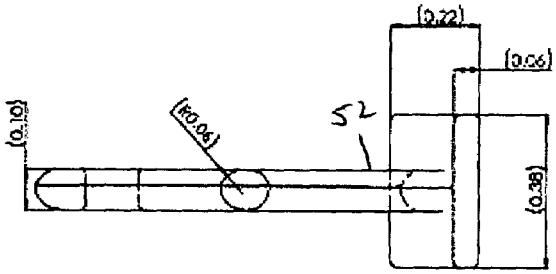
FIG. 54 is an elevational side view illustrating a housing latch of the design template, constructed in accordance with the present invention.

As illustrated in FIGS. 50–53, the design template 16 is an artistic creation that provides a path for the colored texture to travel through giving form to the extruded texture mass. These shapes, as chosen by the user, provide a baseline for the creation of art on the surface. The design template 16 is secured to the compression housing 14 by a housing latch 52, as illustrated in FIGS. 54–56.

Figure 57:
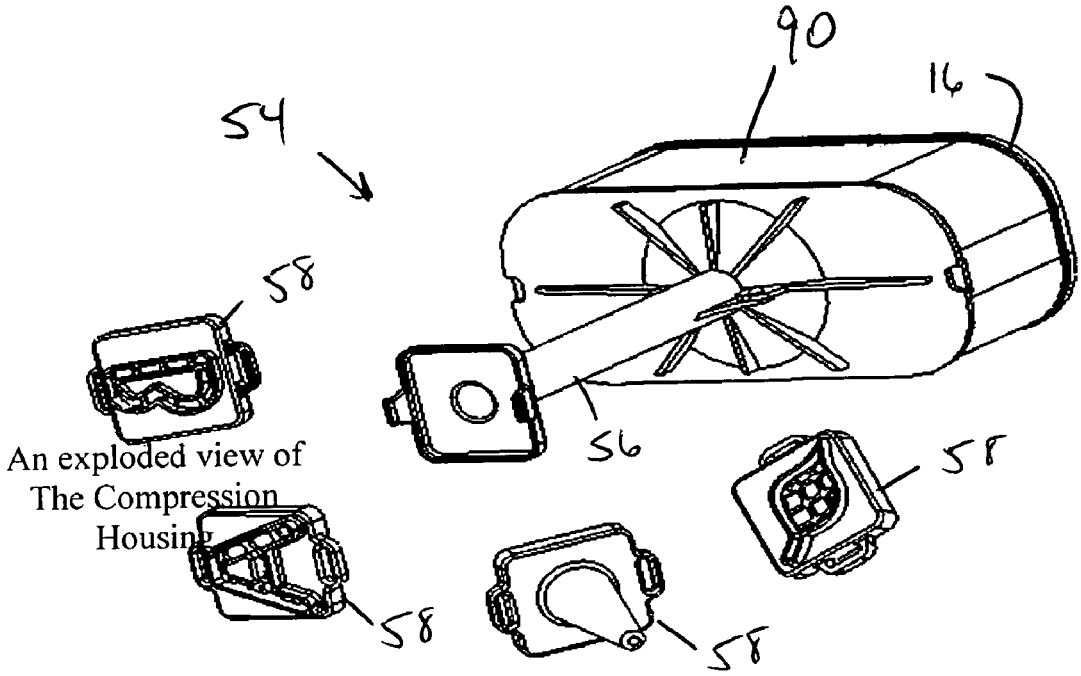
FIG. 57 is an exploded perspective view illustrating an accent stencil adapter of the applicator system, constructed in accordance with the present invention.
Figure 59:
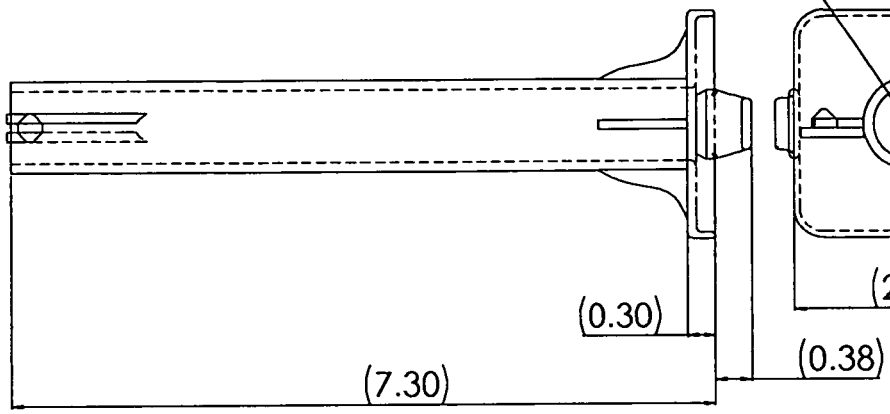
FIG. 59 is an elevational side illustrating the accent extension tube of the accent stencil adapter, constructed in accordance with the present invention.
Figure 60:
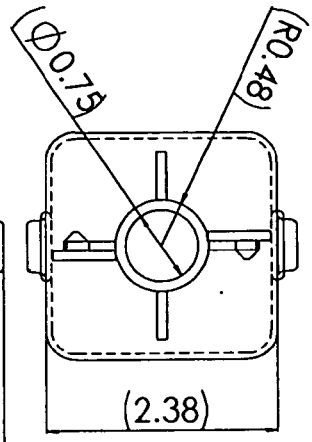
FIG. 60 is a top plan view illustrating the accent extension tube of the accent stencil adapter, constructed in accordance with the present invention.
Figure 58:
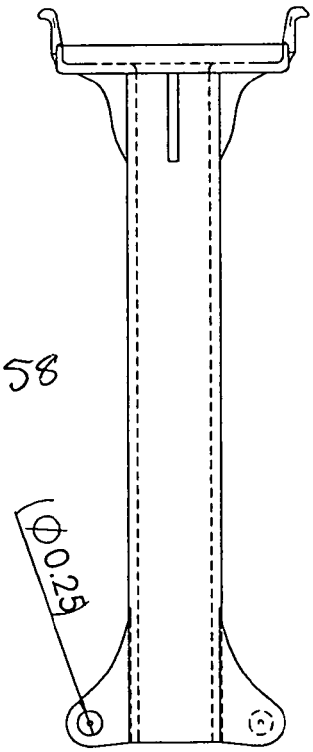
FIG. 58 is a front view illustrating an accent extension tube of the accent stencil adapter, constructed in accordance with the present invention.
Figure 63:
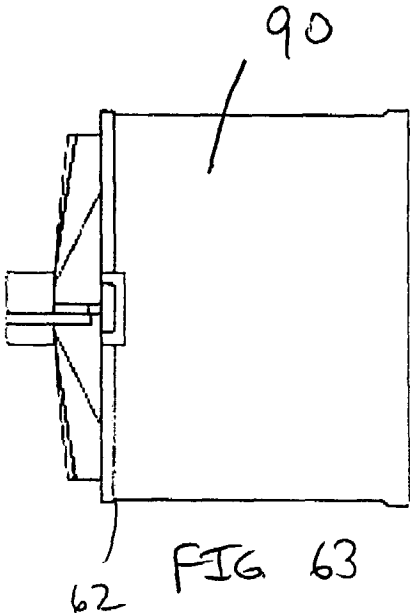
FIG. 63 is an end view illustrating the stencil plate painter adaptor of the accent stencil adaptor, constructed in accordance with the present invention.
Figure 62:
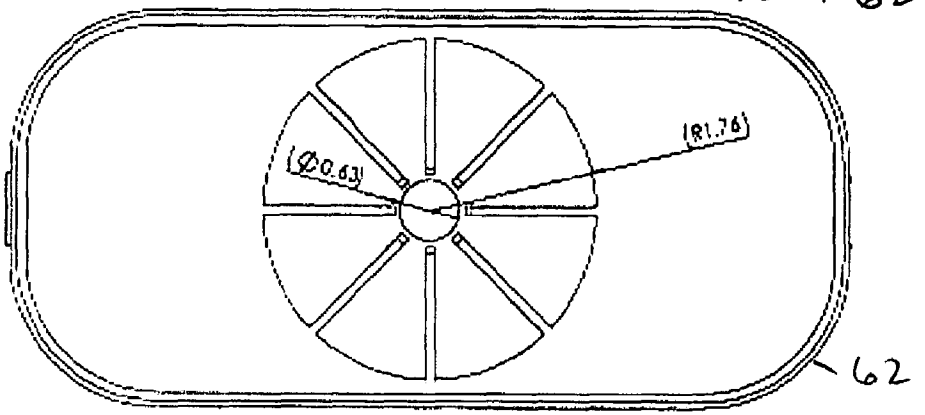
FIG. 62 is a top plan view illustrating the stencil plate painter adaptor of the accent stencil adaptor, constructed in accordance with the present invention.
Figure 61:
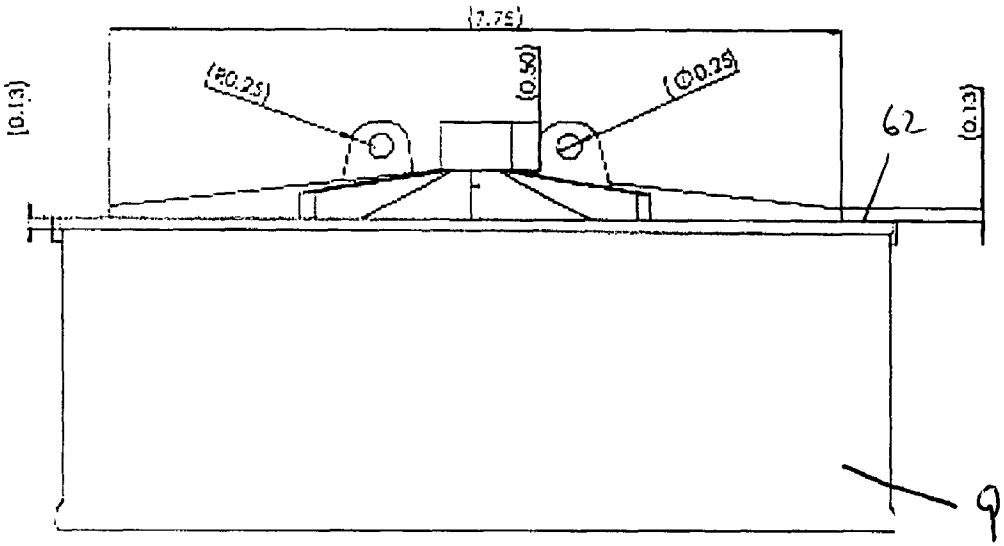
FIG. 61 is an elevational side view illustrating a stencil plate painter adaptor of the accent stencil adaptor, constructed in accordance with the present invention.

As illustrated in FIG. 57, the application system 10 of the present invention includes an accent stencil adapter 54. As illustrated in FIGS. 58–60, the accent stencil adapter 54 includes an accent extension tube 56. The accent extension tube 56 positions an accent stencil 58 further from the base of the compression housing 14 allowing the user to better view the placement of the image. The accent extension tube 56 includes connection pins (not shown) anchoring the accent parts and the texture bladder 90 together. As illustrated in FIGS. 61–63, a stencil plate painter adaptor 62 fits with the extension tube 56 to channel the texture to an end attachment.

Figure 65:
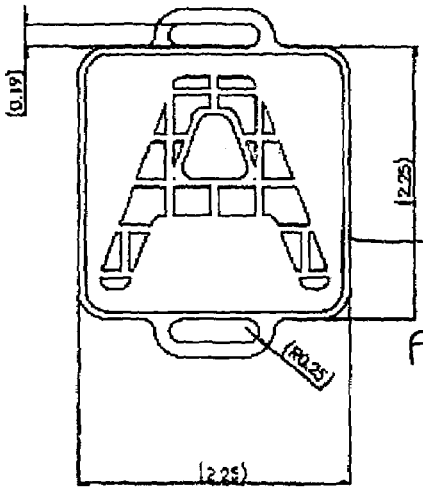
FIG. 65 is a top plan view illustrating the accent stencil, constructed in accordance with the present invention.
Figure 66:
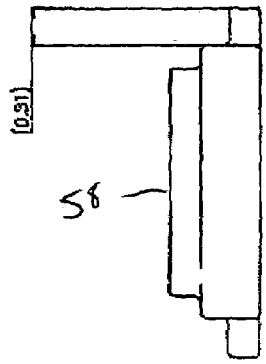
FIG. 66 is an end view illustrating the accent stencil, constructed in accordance with the present invention.
Figure 64:
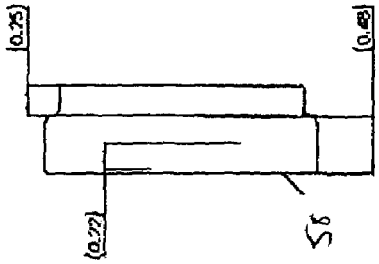
FIG. 64 is an elevational side view illustrating an accent stencil, constructed in accordance with the present invention.

As illustrated in FIGS. 64–66, the two (2") inch accent stencil 58 uses the alphabet and numbers coupled with a variety of patterns to finish the stamped surface image. It should be noted that the accent stencils 58 described and illustrated are only samples of the infinite number of accent stencils 58 which can be used with the present invention.

As illustrated in FIGS. 67–72, the axis cap 64 holds the ratchet handle centered about the axis of rotation and a hole is provided in the axis cap is to fasten the applicator handle and ratchet assembly together. A level cover 66 is used to fill the compression housing wall after the level vial is placed in its slot.

Figure 73:
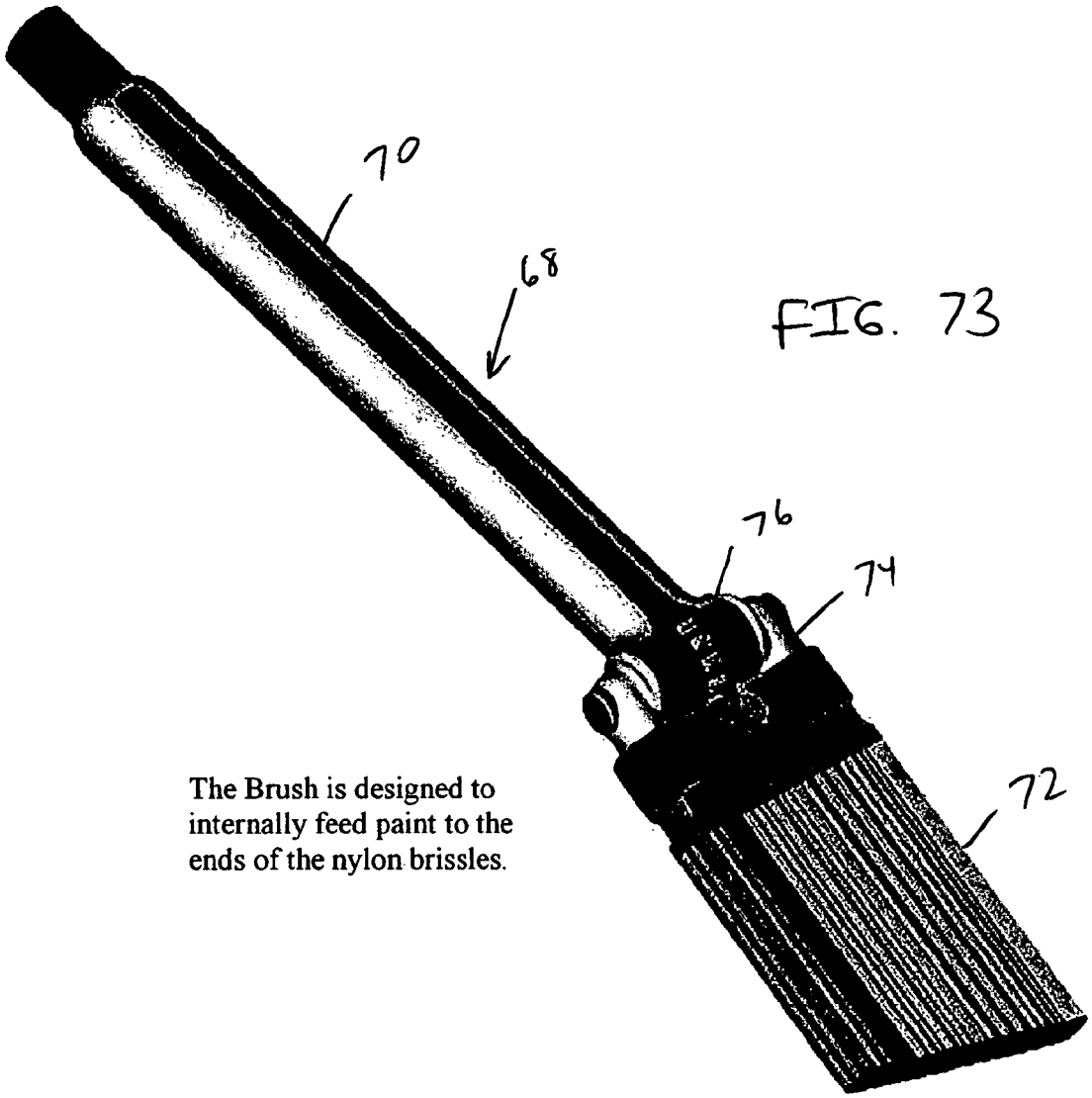
FIG. 73 is a perspective view illustrating an adjustable head paint brush of the applicator system, constructed in accordance with the present invention.
Figure 75:
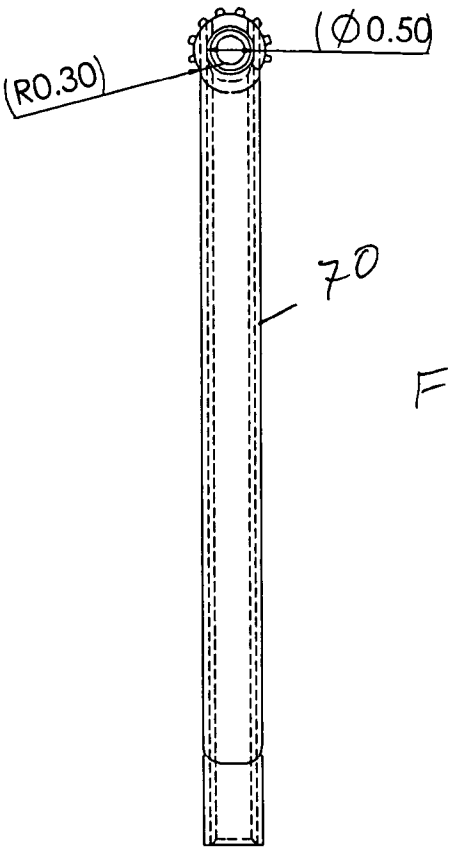
FIG. 75 is a front view illustrating the paint brush handle of the paint brush, constructed in accordance with the present invention.
Figure 74:
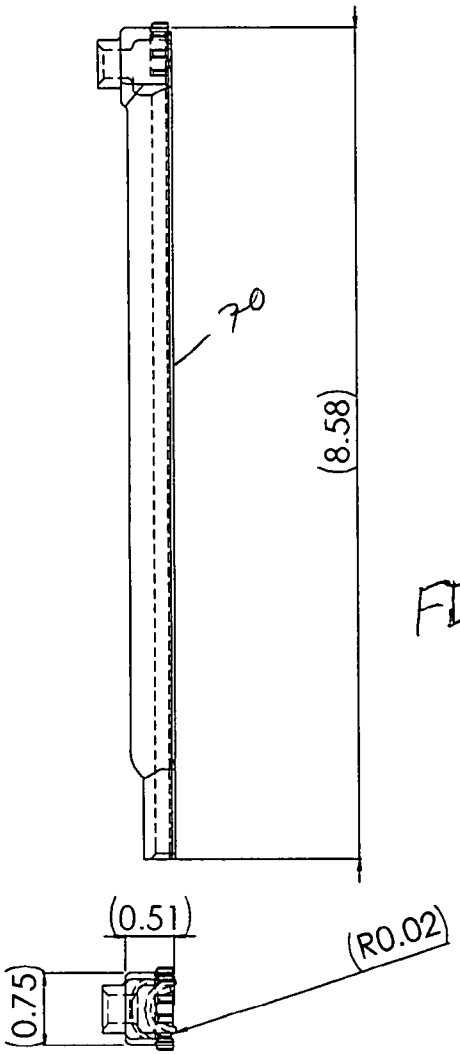
FIG. 74 is an elevational side view illustrating a paint brush handle of the paint brush, constructed in accordance with the present invention.
Figure 78:
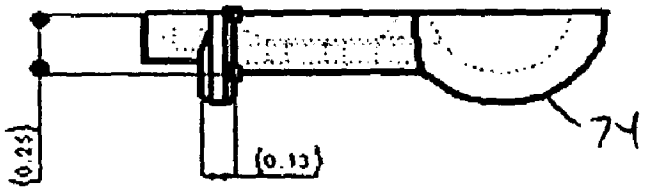
FIG. 78 is an end view illustrating the bristle clamp of the paint brush, constructed in accordance with the present invention.
Figure 77:
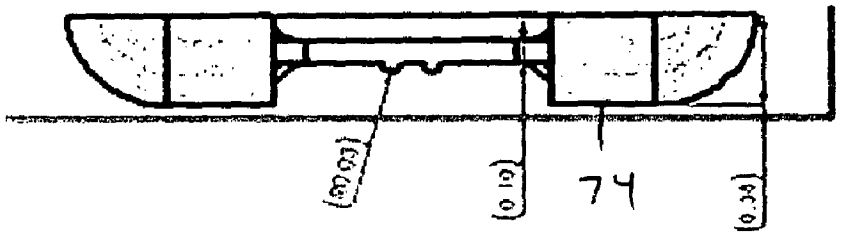
FIG. 77 is a top plan view illustrating the bristle clamp of the paint brush, constructed in accordance with the present invention.
Figure 76:
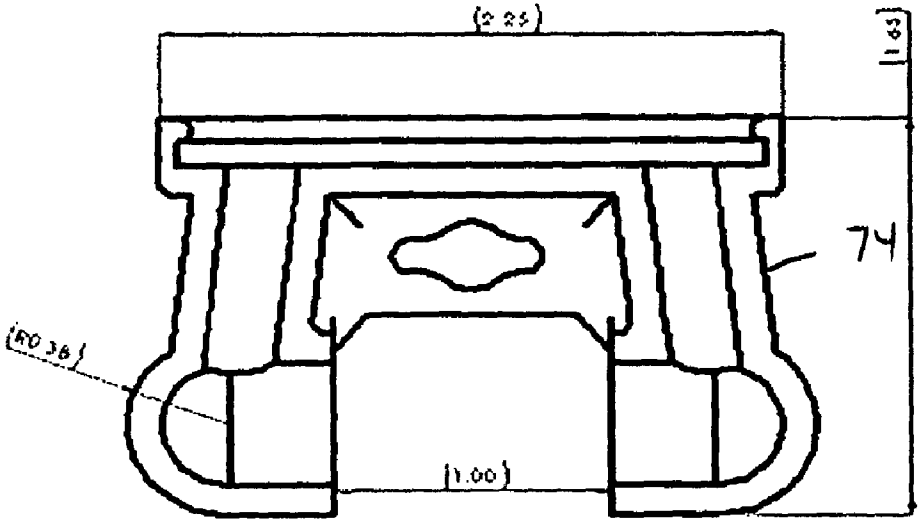
FIG. 76 is an elevational side view illustrating a bristle clamp of the paint brush, constructed in accordance with the present invention.
Figure 81:
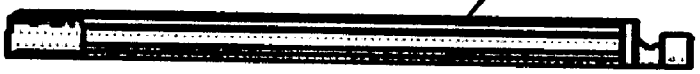
FIG. 81 is an end view illustrating bristles of the paint brush, constructed in accordance with the present invention.
Figure 80:
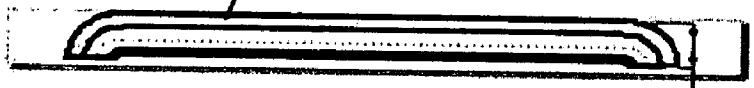
FIG. 80 is a top plan view illustrating bristles of the paint brush, constructed in accordance with the present invention.
Figure 79:
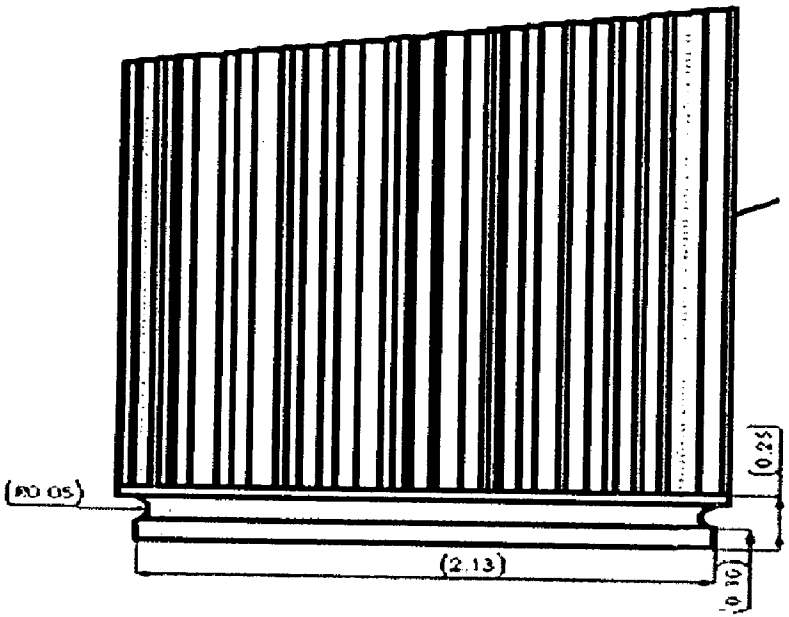
FIG. 79 is an elevational side view illustrating bristles of the paint brush, constructed in accordance with the present invention.
Figure 83:
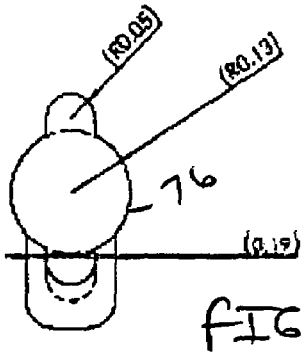
FIG. 83 is a top plan view illustrating the angle latch of the paint brush, constructed in accordance with the present invention.
Figure 84:
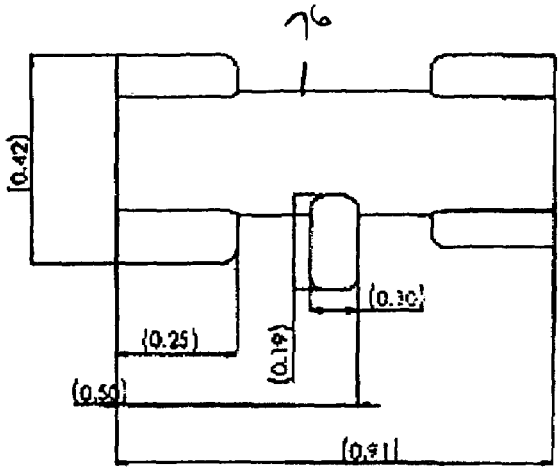
FIG. 84 is an end view illustrating the angle latch of the paint brush, constructed in accordance with the present invention.
Figure 82:
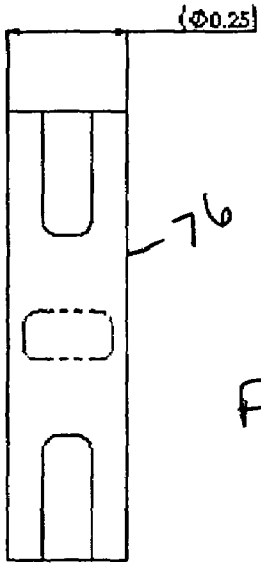
FIG. 82 is an elevational side view illustrating an angle latch of the paint brush, constructed in accordance with the present invention.

As illustrated in FIG. 73, the applicator system 10 of the present invention can include an adjustable head, internally feed paint brush 68 mounted to the compression housing 14. The paint brush 68 has a paint brush handle 70 (preferably in two halves) designed to feed paint to the ends of the bristles 72, as illustrated in FIGS. 74 and 75. Preferably, a two-piece bristles clamp 74 holds the handle 70 and the bristles 72 together and channels the paint to the bristles 72, as illustrated in FIGS. 76–81. An angle latch 76 releasable locks the angle of the brush 68 and compresses the two bristles halves together, as illustrated in FIGS. 82–84.

The texture manifold places the stencils in a specific relation to the guide pins 46 and level bubble 44. The design template 16 is preferably a flat plate with a raised rubber seal 80 lining the perimeter of the stencil design. The design opening is filled with a mesh 78 to dissipate the texture throughout the stencil shape. The perimeter of the plate is enclosed with a flexible plastic wall that will collapse as the texture is applied. Each pattern has multiple barriers to allow for the introduction of various colors within a single image. The upper rim is a stiffening ring to allow the texture seal to clip into the applicator handle. The texture seal provides a two-fold function; it seals the texture bag and provides a flat plate to push against the texture.

Various features provide multiple ways for the user to align the decorative image. First, a level bubble 44 allows the user to maintain a horizontal line. Second, guide pins 46 on either end provide a gage to space or line the design in a pre-determined layout. The guide pins 46 are attached to allow them to pivot for accessing corners.

The applicator system 10 of the present invention is a simple tool to use. The design of the applicator system 10 is developed to aide the user in the free artistic expression. It starts with collecting the texture materials coloring them as desired. The colored texture is then placed within the design patterns. The applicator handle 12 is clipped to the stencil plate 16 and bladder 90, with the compression straps 34 laced. The assembled parts and the filled bladder 90 are slid into the compression housing 14 with the housing latches 52 engaged. The ratchet handle 22 is activated to build pressure within the texture pocket. The multi-colored texture is excreted through the pattern and stamped on the wall. The applicator system's design frees the user to create variations on a design theme.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A hand accent stencil applicator system for positioning a design on a surface, the applicator system comprising:

an applicator handle;

a ratchet handle secured to the applicator handle;

a compression housing mounted to the applicator handle;

a bladder within the compression housing, the bladder holding a texture material; and a texture application device mounted to the compression housing;

wherein the ratchet handle exerts forces into the compression housing causing a texture flow from the bladder through the texture application device.

2. The applicator system of claim 1 wherein the applicator handle has a first applicator handle and a second applicator handle.

3. The applicator system of claim 1 wherein the ratchet handle has a first ratchet handle portion and a second ratchet handle portion, the first ratchet handle portion providing leverage compressing the texture and the second ratchet handle portion enclosing a compression strap centering the axis within its grip.

4. The applicator system of claim 3 and further comprising:

an axis cylinder connecting the first ratchet handle portion and the second ratchet handle portion and providing rotation of the first and second ratchet handles within the applicator handle.

5. The applicator system of claim 4 wherein the applicator handle has at least one roller for providing a path for the compression straps to exert forces on the texture, excreting it through the texture application device.

6. The applicator system of claim 1 wherein the applicator handle has a ratchet lock engaging a compression spool allowing for the equal angular deflection of the ratchet handle and the compression spool.

7. The applicator system of claim 6 wherein the geared compression spool wraps the compression strap around itself to shorten the length of the compression strap thus causing the space between the applicator handle and the texture application device to shorten producing the excretion of the texture through the texture application device.

8. The applicator system of claim 1 wherein the applicator handle has a directional lock for providing a compressive surface to evenly exert pressure over the pool of texture.

9. The applicator system of claim 1 wherein the compression housing has a first compression housing half and a second compression housing half, the first compression housing half surrounding the texture pool reinforcing the perimeter wall and the second compression housing half encompassing the texture and stabilizing the mounting area for the alignment aids.

10. The applicator system of claim 8 and further comprising:

a level bubble mounted on the compression housing.

11. The applicator system of claim 10 and further comprising:

at least one guide pin mounted to the compression housing with a guide pin mounting bracket mounted on the compression housing, the guide pin mounting bracket maintaining the guide pins to the compression housing.

12. The applicator system of claim 11 wherein the guide pins provide a one inch reference along its axis and are coupled with a protractor providing angular alignment to the image, the protractor indicator aligning the guide pins in various desired angles.

13. The applicator system of claim 1 and further comprising:

an accent stencil adapter.

14. The applicator system of claim 13 wherein the accent stencil adapter has an accent extension tube for positioning an accent stencil a predetermined distance from the compression housing.

15. The applicator system of claim 14 wherein the accent extension tube has at least one connection pin anchoring the accent extension tube and the texture bladder together.

16. The applicator system of claim 14 and further comprising:

a stencil plate painter adaptor mounted to the accent extension tube to channel the texture to an end attachment.

17. The applicator system of claim 13 and further comprising:

an axis cap to center a fastener.

18. The applicator system of claim 13 and further comprising a level backing for plugging an opening when a level vial is in place.

19. The applicator system of claim 1 wherein the texture application device is an adjustable head, internally fed paint brush mounted to the compression housing.

20. The applicator system of claim 19 wherein the paint brush has a paint brush handle.

21. The applicator system of claim 20 wherein the paint brush has a bristles clamp for holding the handle and the bristles together and channeling the paint to the bristles.

22. The applicator system of claim of claim 20 and further comprising:

an angle latch for releasably locking the angle of the brush and compressing the two bristles halves together.

23. The applicator system of claim 1 wherein the texture application device is a design template.

24. The applicator system of claim 23 wherein the compression straps connect the applicator handle and the design template urging the applicator handle and the design template closer together.

25. The applicator system of claim 23 and further comprising:

a housing latch for securing the design template to the compression housing.

26. A hand accent stencil applicator system for positioning a design on a surface, the applicator system comprising:

an applicator handle;

a directional lock on the applicator handle;

a compression housing mounted to the applicator housing;

a bladder within the compression housing, the bladder holding a texture material; and a texture application device mounted to the compression housing;

wherein the applicator handle exerts forces into the compression housing causing a texture flow from the bladder through the texture application device; and wherein the directional lock provides a compressive surface to evenly exert pressure over the pool of texture.

27. A hand accent stencil applicator system for positioning a design on a surface, the applicator system comprising:

an applicator handle;

a compression housing mounted to the applicator housing;

a bladder within the compression housing, the bladder holding a texture material;

a texture application device mounted to the compression housing; and a level bubble mounted on the compression housing;

wherein the applicator handle exerts forces into the compression housing causing a texture flow from the bladder through the texture application device and the applicator handle has a directional lock for providing a compressive surface to evenly exert pressure over the pool of texture.

28. A hand accent stencil applicator system for positioning a design on a surface, the applicator system comprising:

an applicator handle;

a compression housing mounted to the applicator housing;

a bladder within the compression housing, the bladder holding a texture material;

a texture application device mounted to the compression housing;

an accent stencil; and an accent stencil adapter;

wherein the applicator handle exerts forces into the compression housing causing a texture flow from the bladder through the texture application device; and wherein the accent stencil adapter has an accent extension tube for positioning an accent stencil a predetermined distance from the compression housing.

29. A hand accent stencil applicator system for positioning a design on a surface, the applicator system comprising:

an applicator handle;

a compression housing mounted to the applicator handle;

a bladder within the compression housing, the bladder holding a texture material;

a texture application device mounted to the compression housing; and a level backing for plugging an opening when the level vial is in place;

wherein the applicator handle exerts forces into the compression housing causing a texture flow from the bladder through the texture application device.

* * * * *